US008405583B2

(12) United States Patent
Ebisuno

(10) Patent No.: US 8,405,583 B2
(45) Date of Patent: Mar. 26, 2013

(54) ORGANIC EL DISPLAY DEVICE AND CONTROL METHOD THEREOF

(75) Inventor: Kouhei Ebisuno, Kyoto (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/419,763

(22) Filed: Mar. 14, 2012

(65) Prior Publication Data

US 2012/0169798 A1 Jul. 5, 2012

Related U.S. Application Data

(63) Continuation of application No. PCT/JP2010/002471, filed on Apr. 5, 2010.

(51) Int. Cl.
*G09G 3/30* (2006.01)

(52) U.S. Cl. ..... 345/76; 345/77

(58) Field of Classification Search ..... 345/76–84
See application file for complete search history.

(56) References Cited

U.S. PATENT DOCUMENTS

| | | | | |
|---|---|---|---|---|
| 6,462,723 | B1 * | 10/2002 | Yamazaki et al. | 345/82 |
| 7,167,147 | B2 | 1/2007 | Tanaka et al. | |
| 7,532,187 | B2 * | 5/2009 | Afentakis et al. | 345/92 |
| 7,545,347 | B2 | 6/2009 | Kanda | |
| 7,616,177 | B2 * | 11/2009 | Peng et al. | 345/76 |
| 8,018,404 | B2 | 9/2011 | Ono | |
| 8,059,068 | B2 | 11/2011 | Kimura | |
| 2001/0007447 | A1 | 7/2001 | Tanaka et al. | |
| 2003/0090481 | A1 | 5/2003 | Kimura | |
| 2004/0174349 | A1 * | 9/2004 | Libsch et al. | 345/204 |
| 2005/0057459 | A1 | 3/2005 | Miyazawa | |
| 2005/0162353 | A1 | 7/2005 | Kanda | |
| 2006/0066512 | A1 * | 3/2006 | Afentakis et al. | 345/55 |
| 2007/0210720 | A1 | 9/2007 | Kimura | |
| 2009/0091521 | A1 | 4/2009 | Kanda | |
| 2009/0278771 | A1 | 11/2009 | Yamamoto et al. | |
| 2010/0053041 | A1 | 3/2010 | Abe et al. | |
| 2010/0220118 | A1 | 9/2010 | Kanegae et al. | |
| 2010/0259531 | A1 | 10/2010 | Ono | |
| 2010/0277402 | A1 | 11/2010 | Miyazawa | |
| 2010/0277449 | A1 | 11/2010 | Kanda | |

(Continued)

FOREIGN PATENT DOCUMENTS

| | | |
|---|---|---|
| JP | 05-218432 | 8/1993 |
| JP | 2001-195028 | 7/2001 |

(Continued)

OTHER PUBLICATIONS

U.S. Appl. No. 13/419,754 to Kouhei Ebisuno et al., filed Mar. 14, 2012.

(Continued)

*Primary Examiner* — Jason Mandeville
(74) *Attorney, Agent, or Firm* — Greenblum & Bernstein, P.L.C.

(57) ABSTRACT

An organic electroluminescent display includes pixels. Each pixel includes a driver, a capacitor between a gate and a source of the driver, a luminescent element connected to the source, and first and second switches. The first switch is between a data line and a first electrode of the capacitor. The second switch is between a power line and a second electrode of the capacitor. A drive circuit provides a bias voltage to a back gate electrode of the driver so that an absolute value of a threshold voltage of the driver is greater than a gate-source voltage of the driver to place the driver in a non-conducting state, and provides a signal voltage to the first electrode of the capacitor and sets a reference voltage to the second electrode of the capacitor.

32 Claims, 20 Drawing Sheets

U.S. PATENT DOCUMENTS

| | | | | |
|---|---|---|---|---|
| 2011/0164024 | A1 | 7/2011 | Ono | |
| 2011/0285760 | A1 | 11/2011 | Ono | |
| 2012/0169707 | A1* | 7/2012 | Ebisuno et al. | 345/212 |

FOREIGN PATENT DOCUMENTS

| | | |
|---|---|---|
| JP | 2002-108252 | 4/2002 |
| JP | 2003-216110 | 7/2003 |
| JP | 2005-208346 | 8/2005 |
| JP | 2009-048212 | 3/2009 |
| JP | 2009-063607 | 3/2009 |
| JP | 2009-069571 | 4/2009 |
| JP | 2009-251205 | 10/2009 |
| JP | 2009-271320 | 11/2009 |
| JP | 2010-060816 | 3/2010 |
| WO | 2009/041061 | 4/2009 |
| WO | 2010/041426 | 4/2010 |

OTHER PUBLICATIONS

International Search Report of PCT/JP2010/002471, dated Jun. 22, 2010.

* cited by examiner

During writing of signal voltage

During production of luminescence with maximum gradation level

During writing of signal voltage

During production of luminescence with maximum gradation level

ORGANIC EL DISPLAY DEVICE AND CONTROL METHOD THEREOF

CROSS REFERENCE TO RELATED APPLICATION

This is a continuation application of PCT Application No. PCT/JP2010/002471 filed on Apr. 5, 2010, designating the United States of America, the disclosure of which, including the specification, drawings and claims, is incorporated herein by reference in its entirety.

BACKGROUND OF THE INVENTION

1. Field of the Invention

The present invention relates to active-matrix organic electroluminescence (EL) display devices using organic EL elements.

2. Description of the Related Art

In organic electroluminescent (EL) display devices, a display unit is provided in which pixel units each including a luminescent element and a driving element for driving the luminescent element are arranged in a matrix, and multiple scan lines and multiple data lines are provided so as to correspond to the pixel units included in the display unit. For example, in the case where each of the pixel units is composed of two transistors and one capacitor and the first power lines electrically connected to source electrodes of the driving elements are provided in directions both parallel to and orthogonal to the scan lines so as to form a grid pattern, the gate electrode of the driving element is connected to the first electrode of the capacitor and the source electrode of the driving element is connected to the second electrode of the capacitor (refer to Japanese Patent Application Publication No. 2002-108252, for example). In this case, a signal voltage is provided to the first electrode of the capacitor, and a voltage at the second electrode of the capacitor connected to the source electrode is determined according to a voltage in the first power line. It is to be noted that the rows may be hereinafter referred to as lines.

SUMMARY OF THE INVENTION

The above conventional technique, however, have the following problems.

That is, in the line in operation for producing luminescence among the lines parallel to the scan lines, the voltage fluctuates due to a voltage drop which occurs when a current flows in the first power line. At this time, in the case where a signal voltage corresponding to a video signal is written in each of the pixel units included in a line adjacent to the line in operation for producing luminescence, the grid pattern of the first power lines leads to the result that the first power line provided to the line in operation for writing the signal voltage is influenced by the voltage drop in the first power line provided to the line in operation for producing luminescence, via wiring provided in the direction perpendicular to the scan lines. In other words, a voltage drop in the first power line for the line which is provided in parallel with the scan lines and is in operation for producing luminescence transmits to the first power line for the line which is provided in parallel with the scan lines and is in operation for writing a signal voltage. This causes a change in potential of the first power lines which are provided in the direction parallel to the scan lines and correspond to the lines in operation for writing a signal voltage.

Furthermore, the influence of the voltage drop on the lines in operation for producing luminescence is larger on a part closer to the center of the display unit, which results in variation in voltage provided from the first power lines to the respective pixel units provided in the lines in operation for writing a signal voltage.

Thus, when a signal voltage is written in the first electrode of the capacitor in a state where the first power lines have a reduced voltage due to the voltage drop, the capacitor holds a voltage lower than a desired voltage because the signal voltage is provided to the first electrode of the capacitor with the second electrode having a decreased voltage. Moreover, the voltages held by the capacitors vary among the respective pixel units. As a result, not only the luminance of the display unit becomes lower, but also there is a variation in the luminance of the display unit, which causes the problem that the display unit is unable to produce luminescence with a desired luminance.

In addition, during a period for which a signal voltage is written, the driving element may become conducting and thus, a drive current of the driving element may flow. In this case, the drive current flowing through the first power lines during the period for which a signal voltage is written causes a change in the voltage of the first power lines. As a result, a voltage lower than a desired voltage is held by the capacitor.

To solve such problems, there is a method of writing a desired voltage in a capacitor by scanning one or both of the first power line and the second power line for each of the lines parallel to the scanning lines and thereby causing the transition of a driving element between conducting and non-conducting states according to whether the luminescent element is in operation for producing luminescence or a signal voltage is written (refer to Japanese Patent Application Publication No. 2009-271320, for example). In this method, while luminescence is produced, the voltages of the first power line and the second power line are controlled so that a forward bias voltage is applied to the luminescent pixel, and while a signal voltage is provided, the voltages of the first power line and the second power line are controlled so that no forward bias voltage is applied to the luminescent element. This makes it possible to prevent a drive current from flowing to the luminescent element via the first power line within a period during which a signal voltage is provided.

However, in this case, it is necessary to additionally provide a dedicated driver for changing the voltage of the first power line and the second power line, which causes a problem of cost increase.

In the mean time, there is also a method of preventing flow of a drive current during a period for which a signal voltage is provided, by switching off, within the period, a transistor for switching additionally provided between the first and second power lines and the luminescent element (refer to Japanese Patent Application Publication No. 2009-69571, for example). This method, however, has the problem that additionally providing the transistor for switching increases the number of elements included in pixel units and the number of wiring channels for controlling the transistor, which not only reduces yield in the manufacturing process but also causes an increase in power voltage which is provided from the power supply, leading to increased power consumption.

The present invention has been devised in view of the above problems, and an object of the present invention is to provide an organic EL display device of which display unit includes pixel units each having a simplified structure and which is capable of causing the pixel unit to produce luminescence with a desired luminance.

In order to achieve the above object, an organic EL display device according to an aspect of the present invention includes: a plurality of pixel units arranged in a matrix, wherein each of the pixel units includes: a luminescent element including a first electrode and a second electrode; a capacitor for holding a voltage; a driving element having a gate electrode connected to a first electrode of the capacitor and a source electrode connected to a second electrode of the capacitor, and allowing a drive current corresponding to the voltage held by the capacitor to flow to the luminescent element to cause the luminescent element to produce luminescence, the driving element having a back gate electrode to which a predetermined bias voltage is provided to place the driving element in a non-conducting state; a first power line electrically connected to the source electrode of the driving element via the luminescent element; a second power line electrically connected to a drain electrode of the driving element; a third power line which is different from the first power line, for setting a predetermined reference voltage for the second electrode of the capacitor; a data line for providing a signal voltage; a first switching element having one terminal connected to the data line and the other terminal connected to the first electrode of the capacitor, and selecting conduction or non-conduction between the data line and the first electrode of the capacitor; a second switching element having one terminal connected to the second electrode of the capacitor and the other terminal connected to the third power line, and selecting conduction or non-conduction between the second electrode of the capacitor and the third power line; and a bias line for providing the predetermined bias voltage to the back gate electrode, the organic EL display device further comprises a drive circuit which controls the first switching element, the second switching element, and the bias voltage that is provided to the back gate electrode, the predetermined bias voltage is provided so that an absolute value of a threshold voltage of the driving element is larger than a voltage between the gate electrode and the source electrode of the driving element, and the drive circuit (i) provides the predetermined bias voltage to the back gate electrode so that the absolute value of the threshold voltage of the driving element is larger than the voltage between the gate electrode and the source electrode, to place the driving element in the non-conducting state, and (ii) sets the predetermined reference voltage for the second electrode of the capacitor and concurrently provides the signal voltage to the first electrode of the capacitor when the driving element is in the non-conducting state, by placing the first switching element and the second switching element in a conducting state within a period during which the predetermined bias voltage is provided.

As described above, in the case where the second electrode of the capacitor is connected to the first power line electrically connected to the source electrode of the driving element, the voltage at the second electrode of the capacitor is influenced by a voltage drop in the first power line. Accordingly, the voltage held by the capacitor fluctuates when the signal voltage is provided.

In the present aspect, the third power line is therefore provided, which is different from the first power line, to set the predetermined reference voltage for the second electrode of the capacitor. The second electrode, that is on the side of the fixed voltage, of the capacitor is connected to the third power line. As a result, since the second electrode of the capacitor is connected to the third power line during the period for which a signal voltage is written, it is possible to prevent a voltage drop in the first power line from influencing the second electrode of the capacitor and thus prevent fluctuations in the voltage held by the capacitor.

With this, in the present aspect, the back gate electrode is used to stop the drive current of the driving element and in the state where the drive current is suspended, the predetermined reference voltage is set for the second electrode of the capacitor, and the signal voltage is provided to the first electrode of the capacitor. Thus, with the drive current suspended, the predetermined reference voltage is set for the second electrode of the capacitor while the signal voltage is provided to the first electrode of the capacitor, which makes it possible to prevent fluctuations in the voltage of the second electrode of the capacitor which occur due to the drive current flowing during the period for which a signal voltage is provided. As a result, the capacitor is capable of holding a desired voltage, and each of the luminescent pixels included in the display unit is thus capable of producing luminescence with a desired luminance.

In the present embodiment, the back gate electrode is used as a switch for causing the transition of the driving element between conducting and non-conducting states. The predetermined bias voltage is applied to the driving element so that the threshold voltage of the driving element is larger than the voltage between the gate electrode and the source electrode of the driving element. As the conduction of the driving element between the conducting and non-conducting states is controlled through control of the bias voltage to be provided, the back gate electrode can be used as a switching element. This eliminates the need of providing another switching element for cutting the drive current off during the period for which the signal voltage is written. As a result, it is possible to simplify the circuitry design of each of the pixel units and thereby reduce the production cost.

In sum, according to the present invention, an organic EL display device is provided which includes a display unit including pixel units each having a simplified structure and is capable of producing luminescence with a predetermined luminance.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT(S)

Figure 1:
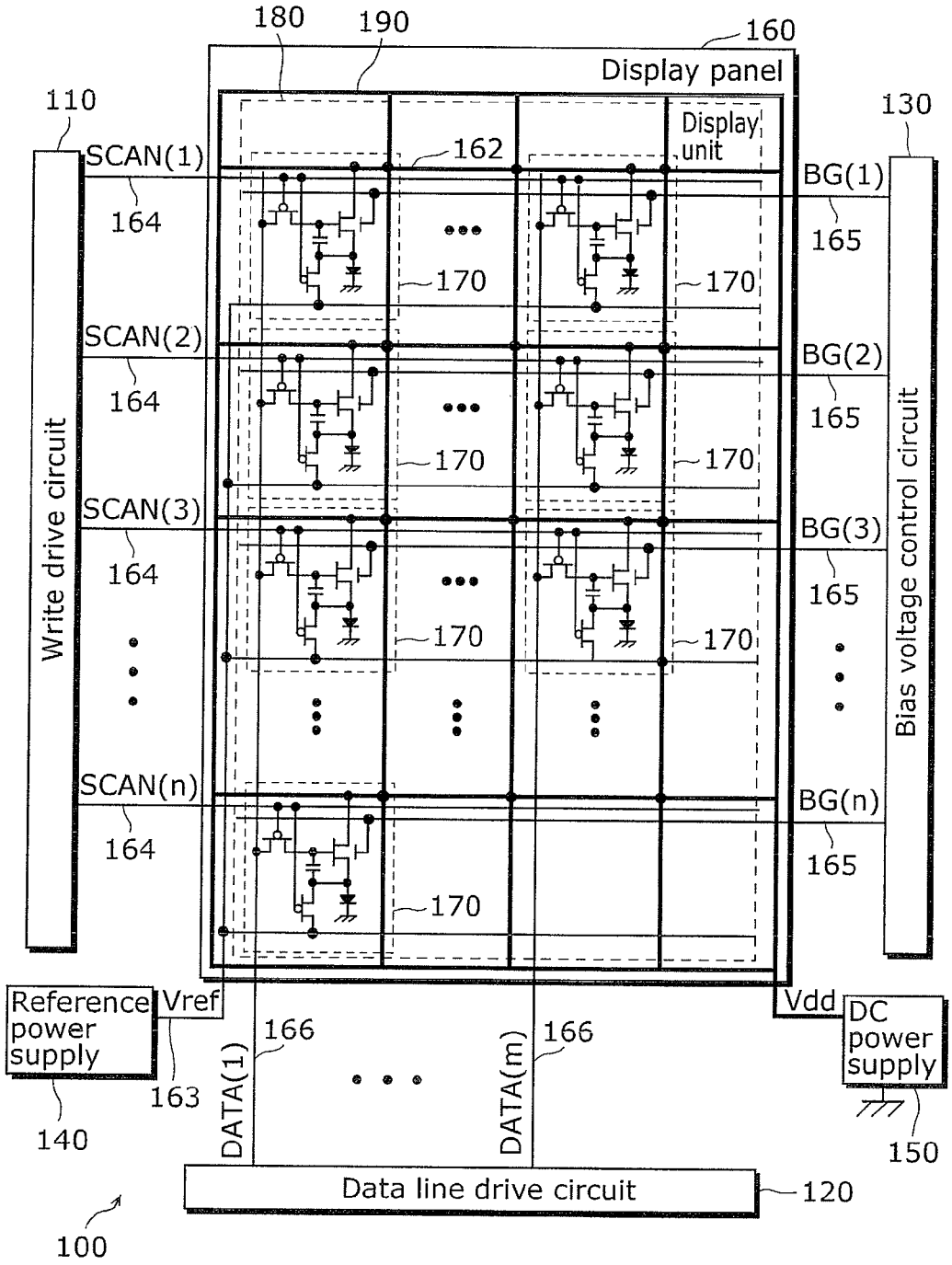
FIG. 1 is a block diagram showing a configuration of an organic EL display device according to the first embodiment.

An organic EL display device according to an aspect of the present invention includes: a plurality of pixel units arranged in a matrix, wherein each of the pixel units includes: a luminescent element including a first electrode and a second electrode; a capacitor for holding a voltage; a driving element having a gate electrode connected to a first electrode of the capacitor and a source electrode connected to a second electrode of the capacitor, and allowing a drive current corresponding to the voltage held by the capacitor to flow to the luminescent element to cause the luminescent element to produce luminescence, the driving element having a back gate electrode to which a predetermined bias voltage is provided to place the driving element in a non-conducting state; a first power line electrically connected to the source electrode of the driving element via the luminescent element; a second power line electrically connected to a drain electrode of the driving element; a third power line which is different from the first power line, for setting a predetermined reference voltage for the second electrode of the capacitor; a data line for providing a signal voltage; a first switching element having one terminal connected to the data line and the other terminal connected to the first electrode of the capacitor, and selecting conduction or non-conduction between the data line and the first electrode of the capacitor; a second switching element having one terminal connected to the second electrode of the capacitor and the other terminal connected to the third power line, and selecting conduction or non-conduction between the second electrode of the capacitor and the third power line; and a bias line for providing the predetermined bias voltage to the back gate electrode, the organic EL display device further comprises a drive circuit which controls the first switching element, the second switching element, and the bias voltage that is provided to the back gate electrode, the predetermined bias voltage is provided so that an absolute value of a threshold voltage of the driving element is larger than a voltage between the gate electrode and the source electrode of the driving element, and the drive circuit (i) provides the predetermined bias voltage to the back gate electrode so that the absolute value of the threshold voltage of the driving element is larger than the voltage between the gate electrode and the source electrode, to place the driving element in the non-conducting state, and (ii) sets the predetermined reference voltage for the second electrode of the capacitor and concurrently provides the signal voltage to the first electrode of the capacitor when the driving element is in the non-conducting state, by placing the first switching element and the second switching element in a conducting state within a period during which the predetermined bias voltage is provided.

As described above, in the case where the second electrode of the capacitor is connected to the first power line electrically connected to the source electrode of the driving element, the voltage at the second electrode of the capacitor is influenced by a voltage drop in the first power line. Accordingly, the voltage held by the capacitor fluctuates when the signal voltage is provided.

In the present aspect, the third power line is therefore provided, which is different from the first power line, to set the predetermined reference voltage for the second electrode of the capacitor. The second electrode, that is on the side of the fixed voltage, of the capacitor is connected to the third power line. As a result, since the second electrode of the capacitor is connected to the third power line during the period for which a signal voltage is written, it is possible to prevent a voltage drop in the first power line from influencing the second electrode of the capacitor and thus prevent fluctuations in the voltage held by the capacitor.

With this, in the present aspect, the back gate electrode is used to stop the drive current of the driving transistor and in the state where the drive current is suspended, the predetermined reference voltage is set for the second electrode of the capacitor, and the signal voltage is provided to the first electrode of the capacitor. Thus, with the drive current suspended, the predetermined reference voltage is set for the second electrode of the capacitor while the signal voltage is provided to the first electrode of the capacitor, which makes it possible to prevent fluctuations in the voltage of the second electrode of the capacitor which occur due to the drive current flowing during the period for which a signal voltage is provided. As a result, the capacitor is capable of holding a desired voltage, and each of the luminescent pixels included in the display unit is thus capable of producing luminescence with a desired luminance.

In the present embodiment, the back gate electrode is used as a switch for causing the transition of the driving element between conducting and non-conducting states. The predetermined bias voltage is applied to the driving element so that the threshold voltage of the driving element is larger than the voltage between the gate electrode and the source electrode of the driving element. As the transition of the driving element between the conducting and non-conducting states is controlled through control of the bias voltage to be provided, the back gate electrode can be used as a switching element. This eliminates the need of providing another switching element for cutting the drive current off during the period for which the signal voltage is written. As a result, it is possible to simplify the circuitry design of each of the pixel units and thereby reduce the production cost.

In sum, according to the present aspect, an organic EL display device is provided which includes a display unit including pixel units each having a simplified structure and is capable of producing luminescence with a predetermined luminance.

According to an organic EL display device according to an aspect of the present invention, the organic EL display device further includes a trunk power line for providing a predetermined fixed voltage to a display unit including the pixel units arranged in the matrix, the trunk power line being disposed on a periphery of the display unit, wherein the second power line branches from the trunk power line so as to correspond to each row and column of the pixel units arranged in the matrix and form a grid pattern.

According to the present aspect, the second power lines are disposed in a grid pattern so as to correspond to the respective rows and columns of the multiple pixel units arranged in a matrix. In this case, the total resistance of the second power lines is smaller for the second power lines extending along the columns, as compared to the case where the second power lines branching from the trunk power line do not extend along the columns but extend only along the rows. Accordingly, the present aspect reduces the voltage drops which occur in the second power lines 162. It is therefore possible to reduce the fixed voltage Vdd which is provided from the DC power supply 150, and thereby reduce the power consumption.

According to an organic EL display device according to an aspect of the present invention, the predetermined bias voltage which is provided so that the threshold voltage of the driving element is larger than the voltage between the gate electrode and the source electrode is set so that the absolute value of the threshold voltage of the driving element is larger than the voltage between the gate electrode and the source electrode when the gate electrode of the driving element is supplied with a predetermined signal voltage that is required to cause the luminescent element in each of the pixel units to produce luminescence with a maximum gradation level.

According to the present aspect, the predetermined bias voltage is set so that the threshold voltage of the driving element is larger than the voltage between the gate electrode and the source electrode when the gate electrode of the driving element is supplied with the predetermined signal voltage that is required to cause the luminescent element in each of the pixel units to produce luminescence with the maximum gradation level. In this case, setting the predetermined bias voltage allows the driving element to have a threshold voltage of which absolute value is larger than the voltage between the gate electrode and the source electrode, no matter what signal voltage corresponding to any one of the gradation levels is written. As a result, it is possible to stop the drive current by reliably causing the transition of the driving element to the non-conduction state when a signal voltage is being written.

According to an organic EL display device according to an aspect of the present invention, the organic EL display device further includes a first scan line for providing a signal for controlling the first switching element between a conducting state and a non-conducting state; and a second scan line for providing a signal for controlling the second switching element between a conducting state and a non-conducting state.

According to an organic EL display device according to an aspect of the present invention, the third power line and the bias line correspond to each row of the pixel units arranged in the matrix, and the third power line corresponding to one of the rows and the bias line corresponding to a previous one of the rows are the same line.

According to the present aspect, the third power line included in each of the pixels arranged in one row and the bias line included in each of the pixels arranged in a previous row are the same line. Thus, switching on and off by the back gate electrode of the driving element reduces TFTs and further reduces the number of wiring channels. It is therefore possible to greatly reduce the size of the circuitry design and to prevent influences of a voltage drop.

According to an organic EL display device according to an aspect of the present invention, the drive circuit provides, through the bias line that is the same line as the third power line, the predetermined reference voltage to the driving element included in each of the pixel units arranged in the previous row, to place the driving element in the conducting state, and concurrently sets, through the third power line that is the same line as the bias line, the predetermined reference voltage for the second electrode of the capacitor included in each of the pixels units arranged in the one row.

According to the present aspect, each of the pixel units arranged in the one row is producing no luminescence while each of the pixel units arranged in the previous row is producing luminescence. Thus, in the case where the third power line included in each of the pixels arranged in the one row and the bias line included in each of the pixels arranged in the previous row are the same, the second electrode of the capacitor included in each of the pixel units arranged in the one row is supplied with not the predetermined reference voltage but the back gate voltage via the third power line that is the same line as the bias line. At this time, part of the range of the signal voltage which is provided from the data line is offset according to the voltage between the predetermined bias voltage and the predetermined reference voltage so that the capacitor can hold a predetermined voltage. Thus, even when the second electrode of the capacitor included in each of the pixel units arranged in the one row is supplied with the predetermined bias voltage through the bias line that is the same line as the third power line during the period for which the pixel unit produces luminescence, there are no operational problems.

According to an organic EL display device according to an aspect of the present invention, the driving circuit provides, through the bias line that is the same line as the third power line, the predetermined bias voltage to the driving element included in each of the pixel units arranged in the previous row, to place the driving element in the non-conducting state, and concurrently places the second switching element in a non-conducting state so that the predetermined bias voltage is not written in the second electrode of the capacitor included in each of the pixels units arranged in the one row through the third power line that is the same line as the bias line.

According to the present aspect, each of the pixel units arranged in the one row is producing luminescence while each of the pixel units arranged in the previous row is producing no luminescence. Thus, even when the third power line included in each of the pixels arranged in the one row and the bias line included in each of the pixels arranged in the previous row are the same, the voltage at the source electrode of the driving element will not fluctuate by placing the second switching element in the non-conducting state so that the second electrode of the capacitor included in each of the pixel units arranged in the one row is not supplied with the predetermined bias voltage through the third power line that is the same line as the bias line. There is thus no influence on the production of luminescence in each of the pixel units arranged in the one row.

According to an organic EL display device according to an aspect of the present invention, the first scan line and the second scan line are provided as a common control line. It is to be noted that providing the lines as the common line means that the lines are the same line.

According to the present aspect, the first scan line for scanning the first switching element and the second scan line for scanning the second switching element may be provided as the common control line.

According to an organic EL display device according to an aspect of the present invention, the first switching element and the driving element are transistors of opposite polarities, a period during which the predetermined bias voltage is provided to the back gate electrode is the same as a period during which the signal voltage is provided to the first electrode of the capacitor, and the first scan line and the bias line are provided as a common control line.

According to the present aspect, the first switching element and the driving element are transistors of opposite polarities, and the period for which the predetermined voltage is provided to the back gate electrode is set to be the same as the period for which the signal voltage is provided to the first electrode of the capacitor. In this case, the signal which is provided to the first switching element has a reversed polarity which is the same as the polarity of the back gate electrode, so that the scan line and the bias line can be the common control line. This allows a reduction in the number of wiring channels in the display unit, which can simplify the circuitry design.

According to an organic EL display device according to an aspect of the present invention, the driving element is an N-type transistor.

According to an organic EL display device according to an aspect of the present invention, the predetermined reference voltage which is provided through the third power line is equal to or lower than a voltage of the first power line.

According to the present aspect, in the case where the driving element is an N-type transistor, a value of the predetermined reference voltage which is provided from the third power line is set to be equal to or lower than the voltage of the first power line. Consequently, when the predetermined reference voltage is set for the second electrode of the capacitor, the voltage at the first electrode of the luminescent element is equal to or lower than the voltage at the second electrode of the luminescent element, so that no current flows from the third power line to the luminescent element. As a result, it is possible to prevent a decrease in contrast which is due to unnecessary production of luminescence during the period for which the signal voltage is provided to the capacitor.

According to an organic EL display device according to an aspect of the present invention, the drive circuit (i) provides the signal voltage to the first electrode of the capacitor and then places the first switching element in a non-conducting state, (ii) provides, to the back gate electrode, a voltage higher than the predetermined bias voltage so that the threshold voltage of the driving element is smaller than the voltage between the gate electrode and the source electrode, to place the driving element in the conducting state, and (iii) provides, to the luminescent element, a drive current corresponding to the voltage held by the capacitor, so as to cause the luminescent element to produce luminescence.

According to the present aspect, in the case where the driving element is an N-type transistor, the signal voltage is provided to the first electrode of the capacitor, and the back gate electrode is then supplied with the reverse bias voltage that is higher than the predetermined bias voltage. This causes the transition of the driving element from the non-conducting state to the conducting state, which allows the drive current corresponding to the voltage held by the capacitor to flow to the luminescent element and thereby causes the luminescent element to produce luminescence.

This makes it possible to prevent the voltage drop which occurs due to the drive current flowing during the period for which the signal voltage is written, so that the capacitor is capable of holding a desired voltage. As a result, the driving element is capable of allowing the drive current corresponding to the desired voltage to flow and thereby causing the luminescent element to produce luminescence.

According to an organic EL display device according to an aspect of the present invention, the driving element is a P-type transistor.

According to an organic EL display device according to an aspect of the present invention, the predetermined reference voltage which is provided through the third power line is equal to or higher than a voltage of the first power line.

According to the present aspect, in the case where the driving element is a P-type transistor, a value of the predetermined reference voltage which is provided from the third power line is set to be equal to or higher than the voltage of the first power line. Consequently, when the predetermined reference voltage is set for the second electrode of the capacitor, the voltage at the second electrode of the luminescent element is equal to or higher than the voltage at the first electrode of the luminescent element, so that no current flows from the luminescent element to the third power line. As a result, it is possible to prevent a decrease in contrast which is due to unnecessary production of luminescence during the period for which the signal voltage is provided to the capacitor.

According to an organic EL display device according to an aspect of the present invention, the drive circuit (i) provides the signal voltage to the first electrode of the capacitor and then places the first switching element in a non-conducting state, (ii) provides, to the back gate electrode, a voltage lower than the predetermined bias voltage so that the threshold voltage of the driving element is smaller than the voltage between the gate electrode and the source electrode, to place the driving element in the conducting state, and (ii) provides, to the luminescent element, a drive current corresponding to the voltage held by the capacitor, so as to cause the luminescent element to produce luminescence.

According to the present aspect, in the case where the driving element is an N-type transistor, the signal voltage is provided to the first electrode of the capacitor, and the back gate electrode is then supplied with the reverse bias voltage that is higher than the predetermined bias voltage. The supply of the bias voltage to the back gate electrode is then stopped to cause the transition of the driving element from the non-conducting state to the conducting state, which allows the drive current corresponding to the voltage held by the capacitor to flow to the luminescent element and thereby causes the luminescent element to produce luminescence.

This makes it possible to prevent the voltage drop which occurs due to the drive current flowing to the third power line during the period for which the signal voltage is written, so that the capacitor is capable of holding a desired voltage. As a result, the driving element is capable of allowing the drive current corresponding to the desired voltage to flow and thereby causing the luminescent element to produce luminescence.

According to a method of controlling an organic EL display device according to an aspect of the present invention, the method is to control an organic EL display device which includes: a luminescent element including a first electrode and a second electrode; a capacitor for holding a voltage; a driving element having a gate electrode connected to the first electrode of the capacitor and a source electrode connected to the second electrode of the capacitor, and allowing a drive current corresponding to the voltage held by the capacitor to flow to the luminescent element to cause the luminescent element to produce luminescence, the driving element having a back gate electrode to which a predetermined bias voltage is provided to place the driving element in a non-conducting state; a first power line electrically connected to the source electrode of the driving element via the luminescent element; a second power line electrically connected to a drain electrode of the driving element; a third power line which is different from the first power line, for setting a predetermined reference voltage for the second electrode of the capacitor; a data line for providing a signal voltage; a first switching element having one terminal connected to the data line and the other terminal connected to the first electrode of the capacitor, and selecting conduction or non-conduction between the data line and the first electrode of the capacitor; a second switching element disposed between the second electrode of the capacitor and the third power line and selecting conduction or non-conduction between the second electrode of the capacitor and the third power line; and a bias line for providing the predetermined bias voltage to the back gate electrode, wherein the predetermined bias voltage is provided so that an absolute value of a threshold voltage of the driving element is larger than a voltage between the gate electrode and the source electrode of the driving element, and the method includes: providing the predetermined bias voltage to the back gate electrode so that an absolute value of the threshold voltage of the driving element is larger than the voltage between the gate electrode and the source electrode, to place the driving element in the non-conducting state, and setting the predetermined reference voltage for the second electrode of the capacitor and concurrently providing the signal voltage to the first electrode of the capacitor when the driving element is in the non-conducting state, by placing the first switching element and the second switching element in a conducting state within a period during which the predetermined bias voltage is provided.

According to an organic EL display device according to an aspect of the present invention, the organic EL display device includes: a plurality of pixel units arranged in a matrix, wherein each of the pixel units includes: a luminescent element including a first electrode and a second electrode; a capacitor for holding a voltage; a driving element having a gate electrode connected to a first electrode of the capacitor and a source electrode connected to a second electrode of the capacitor, and allowing a drive current corresponding to the voltage held by the capacitor to flow to the luminescent element to cause the luminescent element to produce luminescence, the driving element having a back gate electrode to which a predetermined bias voltage is provided to place the driving element in a non-conducting state; a first power line electrically connected to the source electrode of the driving element via the luminescent element; a second power line electrically connected to a drain electrode of the driving element; a third power line which is different from the first power line, for setting a predetermined reference voltage for the first electrode of the capacitor; a data line for providing a signal voltage; a first switching element having one terminal connected to the data line and the other terminal connected to the second electrode of the capacitor, and selecting conduction or non-conduction between the data line and the second electrode of the capacitor; a second switching element having one terminal connected to the first electrode of the capacitor and the other terminal connected to the third power line, and selecting conduction or non-conduction between the first electrode of the capacitor and the third power line; and a bias line for providing the predetermined bias voltage to the back gate electrode, the organic display device further includes a drive circuit which controls the first switching element, the second switching element, and the bias voltage that is provided to the back gate electrode, the predetermined bias voltage is provided so that an absolute value of a threshold voltage of the driving element is larger than a voltage between the gate electrode and the source electrode of the driving element, and the drive circuit (i) provides the predetermined bias voltage to the back gate electrode so that the absolute value of the threshold voltage of the driving element is larger than the voltage between the gate electrode and the source electrode, to place the driving element in a non-conducting state, and (ii) sets the predetermined reference voltage for the first electrode of the capacitor and concurrently provides the signal voltage to the second electrode of the capacitor when the driving element is in the non-conducting state, by placing the first switching element and the second switching element in a conducting state within a period during which the predetermined bias voltage is provided.

According to an organic EL display device according to an aspect of the present invention, the organic EL display device further includes a trunk power line for providing a predetermined fixed voltage to a display unit including the pixel units arranged in the matrix, the trunk power line being disposed on a periphery of the display unit, wherein the second power line branches from the trunk power line so as to correspond to each row and column of the pixel units arranged in the matrix and form a grid pattern.

According to an organic EL display device according to an aspect of the present invention, the predetermined bias voltage which is provided so that the threshold voltage of the driving element is larger than the voltage between the gate electrode and the source electrode is set so that the absolute value of the threshold voltage of the driving element is larger than the voltage between the gate electrode and the source electrode when the source electrode of the driving element is supplied with a predetermined signal voltage that is required to cause the luminescent element in each of the pixel units to produce luminescence with a maximum gradation level.

According to an organic EL display device according to an aspect of the present invention, the organic EL display device further includes: a first scan line for providing a signal for controlling the first switching element between a conducting state and a non-conducting state; and a second scan line for providing a signal for controlling the second switching element between a conducting state and a non-conducting state.

According to an organic EL display device according to an aspect of the present invention, the third power line and the bias line correspond to each row of the pixel units arranged in the matrix, and the third power line corresponding to one of the rows and the bias line corresponding to a previous one of the rows are the same line.

According to an organic EL display device according to an aspect of the present invention, the drive circuit provides, through the bias line that is the same line as the third power line, the predetermined reference voltage to the driving element included in each of the pixel units arranged in the previous row, to place the driving element in the conducting state, and concurrently sets, through the third power line that is the same line as the bias line, the predetermined reference voltage for the first electrode of the capacitor included in each of the pixels units arranged in the one row.

According to an organic EL display device according to an aspect of the present invention, the driving circuit provides, through the bias line that is the same line as the third power line, the predetermined bias voltage to the driving element included in each of the pixel units arranged in the previous row, to place the driving element in the non-conducting state, and concurrently places the second switching element in a non-conducting state so that the predetermined bias voltage is not written in the first electrode of the capacitor included in each of the pixels units arranged in the one row through the third power line that is the same line as the bias line.

According to an organic EL display device according to an aspect of the present invention, the first scan line and the second scan line are provided as a common control line.

According to an organic EL display device according to an aspect of the present invention, the first switching element and the driving element are transistors of opposite polarities, a period during which the predetermined bias voltage is provided to the back gate electrode is the same as a period during which the signal voltage is provided to the second electrode of the capacitor, and the first scan line and the bias line are provided as a common control line.

According to an organic EL display device according to an aspect of the present invention, the driving element is an N-type transistor.

According to an organic EL display device according to an aspect of the present invention, a maximum value of the signal voltage which is provided through the data line is equal to or lower than a voltage of the first power line.

With this, in the case where the driving element is an N-type transistor, it is possible to prevent a current flow from the data line to the luminescent element while the signal voltage is written. Consequently, the extinction of the luminescent pixel can be secured during writing of the signal voltage.

According to an organic EL display device according to an aspect of the present invention, the drive circuit (i) provides the signal voltage to the second electrode of the capacitor and then places the first switching element in a non-conducting state, (ii) provides, to the back gate electrode, a voltage higher than the predetermined bias voltage so that the threshold voltage of the driving element is smaller than the voltage between the gate electrode and the source electrode, to place the driving element in the conducting state, and (ii) provides, to the luminescent element, a drive current corresponding to the voltage held by the capacitor, so as to cause the luminescent element to produce luminescence.

According to an organic EL display device according to an aspect of the present invention, the driving element is a P-type transistor.

According to an organic EL display device according to an aspect of the present invention, a minimum value of the signal voltage which is provided through the data line is equal to or larger than a voltage of the first power line.

With this, in the case where the driving element is a P-type transistor, it is possible to prevent a current flow from the luminescent element to the data line while the signal voltage is written. Consequently, the extinction of the luminescent pixel can be secured during writing of the signal voltage.

According to an organic EL display device according to an aspect of the present invention, the drive circuit (i) provides the signal voltage to the second electrode of the capacitor and then places the first switching element in a non-conducting state, (ii) provides, to the back gate electrode, a voltage lower than the predetermined bias voltage so that the threshold voltage of the driving element is smaller than the voltage between the gate electrode and the source electrode, to place the driving element in the conducting state, and (ii) provides, to the luminescent element, a drive current corresponding to the voltage held by the capacitor, so as to cause the luminescent element to produce luminescence.

According to a method of controlling an organic EL display device according to an aspect of the present invention, the method is to control an organic EL display device which includes: a luminescent element including a first electrode and a second electrode; a capacitor for holding a voltage; a driving element having a gate electrode connected to the first electrode of the capacitor and a source electrode connected to the second electrode of the capacitor, and allowing a drive current corresponding to the voltage held by the capacitor to flow to the luminescent element to cause the luminescent element to produce luminescence, the driving element having a back gate electrode to which a predetermined bias voltage is provided to place the driving element in a non-conducting state; a first power line electrically connected to the source electrode of the driving element via the luminescent element; a second power line electrically connected to the source electrode of the driving element via the luminescent element; a third power line which is different from the first power line, for setting a predetermined reference voltage for the first electrode of the capacitor; a data line for providing a signal voltage; a first switching element having one terminal connected to the data line and the other terminal connected to the second electrode of the capacitor, and selecting conduction or non-conduction between the data line and the second electrode of the capacitor; a second switching element disposed between the first electrode of the capacitor and the third power line and selecting conduction or non-conduction between the first electrode of the capacitor and the third power line, and a bias line for providing the predetermined bias voltage to the back gate electrode, wherein the predetermined bias voltage is provided so that an absolute value of a threshold voltage of the driving element is larger than a voltage between the gate electrode and the source electrode of the driving element, and the method includes: providing the predetermined bias voltage to the back gate electrode so that the absolute value of the threshold voltage of the driving element is larger than the voltage between the gate electrode and the source electrode, to place the driving element in the non-conducting state, and setting the predetermined reference voltage for the first electrode of the capacitor and concurrently providing the signal voltage to the second electrode of the capacitor when the driving element is in the non-conducting state, by placing the first switching element and the second switching element in a conducting state within a period during which the predetermined bias voltage is provided.

The following describes preferred embodiments of the present invention based on the drawings. Throughout the drawings, the same or equivalent elements are denoted by the same numerals, and their overlapping descriptions will be omitted hereinbelow.

First Embodiment

In the following, the first embodiment of the present invention is described with reference to the drawings.

FIG. 1 is a block diagram showing a configuration of an organic EL display device according to the present embodiment.

The organic EL display device 100 shown in FIG. 1 includes a write drive circuit 110, a data line drive circuit 120, a bias voltage control circuit 130, a reference power supply 140, a DC power supply 150, and a display panel 160. The display panel 160 includes a display unit 180 having multiple luminescent pixels arranged in n rows and m columns (n and m are each a natural number), and a trunk power line 190 disposed on a periphery of the display unit 180 and through which a predetermined fixed voltage Vdd is provided to the display unit 180, and is connected to the write drive circuit 110, the data line drive circuit 120, the bias voltage control circuit 130, the reference power supply 140, and the DC power supply 150.

Figure 2:
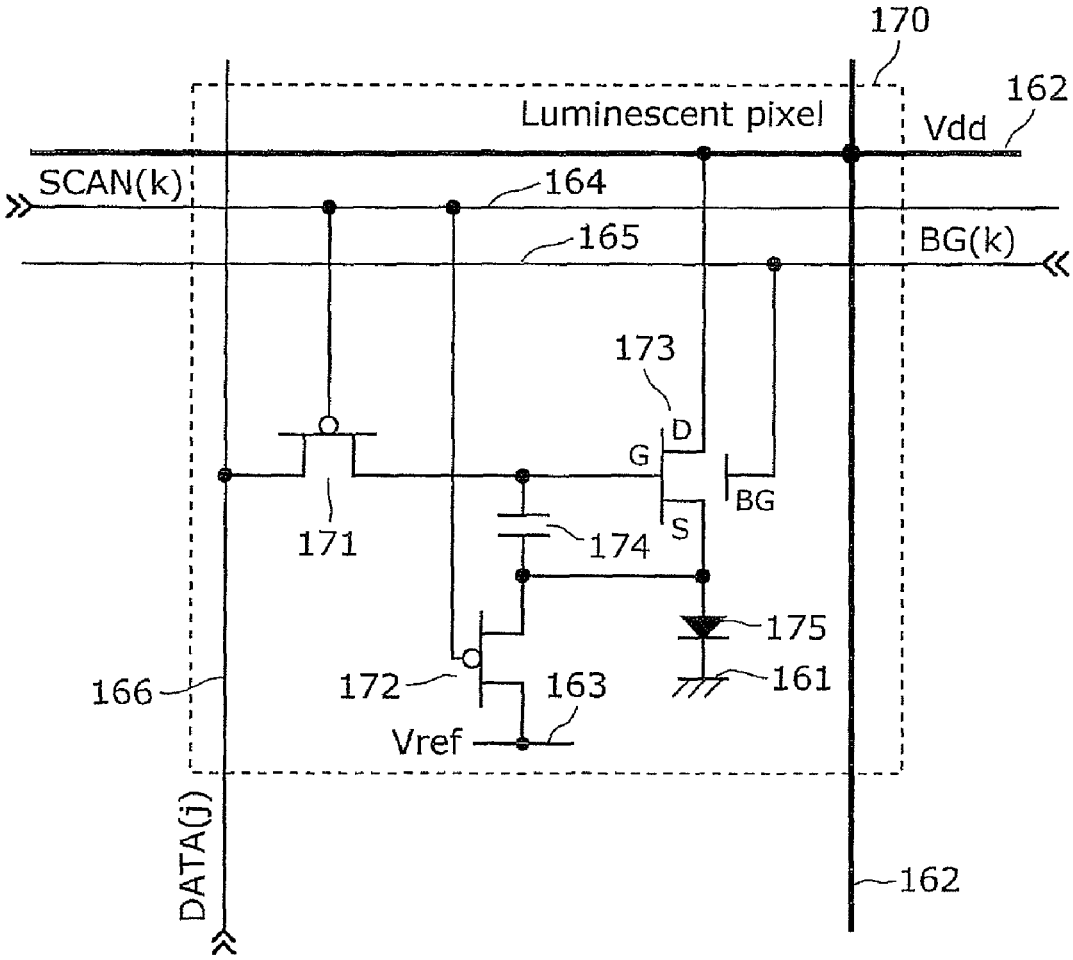
FIG. 2 is a circuit diagram showing a detailed circuitry design of a luminescent pixel.

FIG. 2 is a circuit diagram showing a detailed circuitry design of the luminescent pixel 170.

The luminescent pixel 170 shown in FIG. 2 is the pixel unit according to an implementation of the present invention and includes a first power line 161, second power lines 162, a reference power line 163, a scan line 164, a bias line 165, a data line 166, a scan transistor 171, a reset transistor 172, a drive transistor 173, a capacitor 174, and a luminescent element 175. While the luminescent element 170 located in the "k"-th row and the "j"-th column ($1 \leqq k \leqq n$, $1 \leqq j \leqq m$) is illustrated in FIG. 2 as an example, the other luminescent elements have the same or like structures.

As to the respective constituent elements shown in FIG. 1 and FIG. 2, their connection relationship and functions are described below.

The write drive circuit 110 is connected to the multiple scan lines 164 provided for the respective rows of the multiple luminescent pixels 170 and provides scan pulses SCAN (1) to SCAN (n) to the multiple scan lines, thereby scanning the multiple luminescent pixels 170 sequentially on a per-row basis. These scan pulses SCAN (1) to SCAN (n) are signals for controlling on and off of the scanning transistors 171.

The data line drive circuit 120 is connected to the multiple data lines 166 provided for the respective columns of the multiple luminescent pixels 170 and provides data line voltage DATA (1) to DATA (m) to the multiple data lines 166. The respective data line voltages DATA (1) to DATA (m) include, in a time-division manner, a signal voltage corresponding to the luminance of the luminescent element 175 in a corresponding column. That is, the data line drive circuit 120 provides signal voltages to the multiple data lines 166. The data line drive circuit 120 and the bias voltage control circuit 130 correspond to the drive circuit according to an implementation of the present invention.

The bias voltage control circuit 130 is connected to the multiple bias lines 165 provided for the respective rows of the multiple luminescent pixels 170 and provides back gate pulses BG (1) to BG (n) to the multiple bias lines 165, thereby controlling the threshold voltages of the multiple luminescent pixels 170 on a per-row basis. In other words, the multiple luminescent pixels 170 undergo, in units of rows, the transition between conducting and non-conducting states. The details of control on the threshold voltages of the luminescent pixels 170 by the back gate pulses BG (1) to BG (n) will be described later.

The reference power supply 140 is connected to the reference power line 163 and provides a reference voltage Vref to the reference power line 163.

The DC power supply 150 is connected to the power lines 162 via the trunk power line 190 and provides the fixed potential Vdd to the trunk power line 190. The fixed potential Vdd is 15 V, for example.

The power line 161 is the first power line according to an implementation of the present invention and connected to a drain electrode of the drive transistor 173 via the luminescent element 175. This power line 161 is a ground line at a potential of 0 V, for example.

The second power lines 162 are each the second power line according to an implementation of the present invention and connected to the DC power supply 150 and the drain electrode of the drive transistor 173. This second power line branches from the trunk power line 190 so as to correspond to each row and column of the multiple luminescent elements 170 arranged in a matrix, thereby forming a grid pattern.

The reference power line 163 is the third power line according to an implementation of the present invention and connected to the reference power supply 140 and one of a source electrode and a drain electrode of the reset transistor 172. From the reference voltage 140, the reference voltage Vref is provided to the reference power line 163. This reference voltage Vref is 0 V, for example.

The scan lines 164 are provided for the respective rows of the multiple luminescent pixels 170 in a manner that the multiple luminescent pixels 170 in a row share a corresponding one of the scan lines 164, and connected to the write drive circuit 110 and gate electrodes of the respective scan transistors 171 included in the corresponding luminescent pixels 170.

The bias wires 165 are provided for the respective rows of the multiple luminescent pixels 170 in a manner that the multiple luminescent pixels 170 in a row share a corresponding one of the bias wires 165, and are connected to the bias voltage control circuit 130 and back gate electrodes of the respective drive transistors 173 included in the corresponding luminescent pixels 170.

The data lines 166 are provided for the respective columns of the multiple luminescent pixels 170 in a manner that the multiple luminescent pixels 170 in a column share a corresponding one of the data lines 166, and supplied with the data line voltages DATA (1) to DATA (m) from the data line drive circuit 120.

The scan transistor 171 is the switching element according to an implementation of the present invention, having one terminal connected to the data line 166 and the other terminal connected to the first electrode of the capacitor 174, and selecting conduction or non-conduction between the data line 166 and the first electrode of the capacitor 174. Specifically, the scan transistor 171 has the gate electrode connected to the scan line 164, one of a source electrode and a drain electrode connected to the data line 166, and the other one of the source electrode and the drain electrode connected to the first electrode of the capacitor 174. According to the scan pulse SCAN (k) provided from the write drive circuit 110 to the gate electrode via the scan line 164, the scan transistor 171 selects the conduction or non-conduction between the data line 166 and the first electrode of the capacitor 174.

The reset transistor 172 is the second switching element according to an implementation of the present invention, having one terminal connected to the second electrode of the capacitor 174 and the other terminal connected to the reference power line 163, and selecting conduction or non-conduction between the second electrode of the capacitor 174 and the reference power line 163. Specifically, the reset transistor 172 has a gate electrode connected the write drive circuit 110 via the scan line 164, one of a source electrode and a drain electrode connected to the reference power line 163, and the other one of the source electrode and the drain electrode connected to the second electrode of the capacitor 174. According to the scan pulse SCAN (k) provided from the write drive circuit 110 to the gate electrode via the scan line 164, the reset transistor 172 selects the conduction or non-conduction between the reference power line 163 and the second electrode of the capacitor 174.

The drive transistor 173 is the driving element according to an implementation of the present invention, having a source electrode S, a drain electrode D, a gate electrode G, and a back gate electrode BG. The gate electrode G is connected to the first electrode of the capacitor 174, and the source electrode S is connected to the second electrode of the capacitor 174. The drive transistor 173 allows a drive current according to a voltage held by the capacitor 174 to pass through the luminescent element 175, thereby causing the luminescent element 175 to produce luminescence. When a predetermined bias voltage is provided to the back gate electrode BG, the drive transistor 173 becomes non-conducting. That is, the drive transistor 173 supplies the luminescent element 175 with the drive current, i.e., a drain current according to the voltage held by the capacitor 174. The details of this drive transistor 173 will be described later.

The capacitor 174 is a capacitor for holding a voltage which corresponds to a luminance of the luminescent element 175 of the luminescent pixel 170. Specifically, the capacitor 174 has the first electrode and the second electrode, and the first electrode is connected to the gate electrode of the drive transistor 173 and to the other one of the source electrode and the drain electrode of the scan transistor 171 while the second electrode is connected to the source electrode of the drive transistor 173 and to the other one of the source electrode and the drain electrode of the reset transistor 172. That is, the first electrode of the capacitor 174 has a data line voltage DATA (j) which is provided to the data line 166 when the scan transistor 171 is conducting. The second electrode of the capacitor 174 has the reference voltage Vref that is the fixed voltage of the reference power line 163 while the reset transistor 172 is in the conducting state, and upon the transition of the reset transistor 172 from the conducting state to the non-conducting state, the second electrode of the capacitor 174 is disconnected from the reference power line 163. In other words, the second electrode of the capacitor 174 is an electrode on the side of the fixed voltage.

The luminescent element 175 is a luminescent element having the first electrode and the second electrode and producing luminescence when supplied with the drain current from the drive transistor 173. For example, the luminescent element 175 is an organic EL luminescent element. Of the luminescent element 175, the first electrode is an anode and the second electrode is a cathode, for example.

The scan transistor 171 and the reset transistor 172 are P-type thin-film transistors (P-type TFTs), and the drive transistor 173 is an N-type thin-film transistor (N-type TFT), for example.

Next, characteristics of the above-described drive transistor 153 are described.

Figure 3:
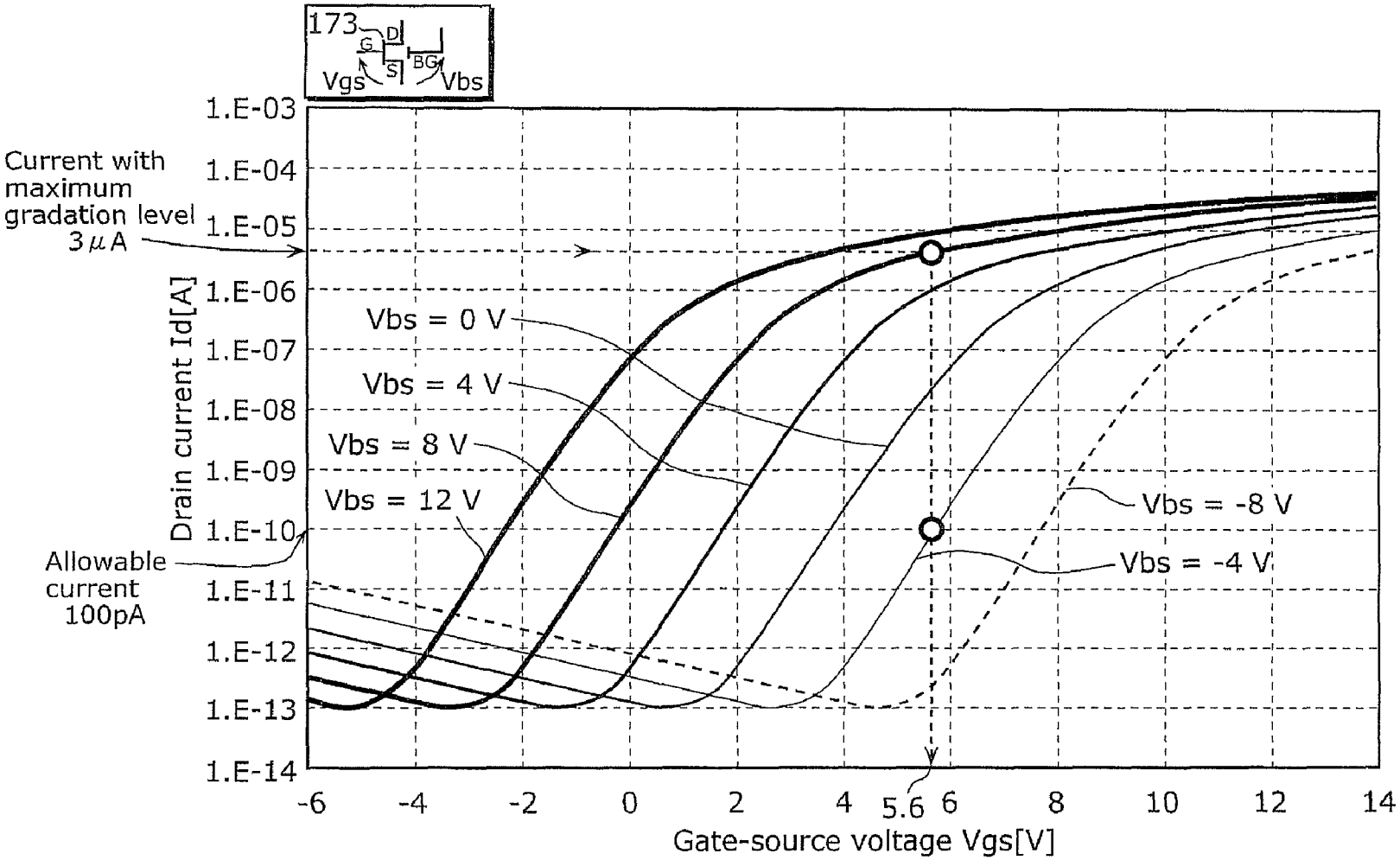
FIG. 3 is a graph showing one example of Vgs-Id characteristics of a drive transistor.

FIG. 3 is a graph showing one example of characteristics of the drain current relative to the gate-source voltage (Vgs-Id characteristics) in the drive transistor 173.

In FIG. 3, the horizontal axis represents the gate-source voltage Vgs of the drive transistor 173 while the vertical axis represents the drain current Id of the drive transistor 173. Specifically, the horizontal axis indicates a voltage at the gate electrode relative to a voltage at the source electrode in the drive transistor 173, and a positive value is obtained when the voltage at the gate electrode is higher than the voltage at the source electrode while a negative value is obtained when the voltage at the gate electrode is lower than the voltage at the source electrode.

FIG. 3 shows the Vgs-Id characteristics for different back gate voltages: specifically, the Vgs-Id characteristics with the back gate-source voltages Vbs of −8 V, −4 V, 0 V, 4 V, 8 V, and 12 V. The back gate-source voltage Vbs of the drive transistor 173 indicates a voltage at the back gate electrode relative to a voltage at the source electrode in the drive transistor 173, and a positive value is obtained when the voltage at the back gate electrode is higher than the voltage at the source electrode while a negative value is obtained when the voltage at the back gate electrode is lower than the voltage at the source electrode.

The Vgs-Id characteristics shown in FIG. 3 reveals that Id differs depending on Vbs even when Vgs is constant. For example, assume that the drive transistor 173 is non-conducting when the drain current Id is equal to or less than 100 pA, and the drive transistor 173 is conducting when the drain current Id is 1 μA or more. In the case of Vgs=6 V and Vbs=−8 V, for example, the drive transistor 173 is non-conducting because Id is equal to or less than 100 pA. Likewise, in the case of Vbs=4 V, 8 V, or 12 V even with Vgs=6 V, the drive transistor 173 is conducting because Id is no less than 1 μA.

On the other hand, in the case of Vbs=−8 V, −4 V, or 0 V with Vgs=2 V, the drive transistor 173 is non-conducting because Id is no more than 100 pA. Likewise, in the case of Vbs=12 V even with Vgs=2 V, the drive transistor 173 is conducting because Id is no less than 1 μA.

The drive transistor 173 thus undergoes the transition between conducting and non-conducting according to Vbs even when Vgs is constant. That is, the threshold voltage of the drive transistor 173 changes according to Vbs. Specifically, the threshold voltage becomes higher as Vbs decreases. Thus, even when the gate-source voltage is constant, the drive transistor 173 undergoes the transition between conducting and non-conducting according to the back gate pulses BG (1) to BG (n) which are provided from the bias voltage control circuit 130 via the bias lines 165.

It is to be noted that the amount of current based on which it is determined whether the drive transistor 173 is conducting or non-conducting is defined depending on a circuit into which the drive transistor 173 is incorporated, and is thus not limited to the above example. Specifically, the state where the drive transistor 173 is conducting indicates a state where a drain current corresponding to the maximum gradation level can be provided when the gate-source voltage of the drive transistor 173 corresponds to the maximum gradation level. On the other hand, the state where the drive transistor 173 is non-conducting indicates a state where the drain current is equal to or less than an allowable current when the gate-source voltage of the drive transistor 173 corresponds to the maximum gradation level.

The allowable current is a drain current at the maximum value with which no voltage drop will occur in the first power line 161. In other words, even when the allowable current flows through the luminescent pixel 170, the amount of the allowable current is sufficiently small so that a voltage drop occurring in the first power line 161 is sufficiently small and thus does not cause a problem.

The following describes a determination on values of high level voltages and low level voltages of the back gate pulses BG (1) to BG (n) which are provided from the bias voltage control circuit 130.

The drive transistor 173 of the luminescent pixel 170 requires the following two conditions.

(Condition i) The luminescent element 175 is supplied with a drain current corresponding to the maximum gradation level when producing luminescence with the maximum gradation level.

(Condition ii) The luminescent pixel 175 is supplied with the drain current equal to or less than the allowable current when a signal voltage is written.

For example, assume that the drain current corresponding to the maximum gradation level is 3 μA and the allowable current during a writing period is 100 pA.

The following describes the determination on values of high level voltages and low level voltages of the back gate pulses BG (1) to BG (n) using the Vgs-Id characteristics shown in FIG. 3.

First, Vbs=8 V is selected as characteristics of the back gate-source voltage for producing luminescence.

Next, the gate-source voltage for producing luminescence with the maximum gradation level is determined. Specifically, since the drain current Id corresponding to the maximum gradation level is 3 μA, the selection of Vbs=8 V as above leads to Vgs=5.6 V.

Next, the back gate-source voltage Vbs at which the drain current Id is equal to or less than the allowable current in writing of the signal voltage is selected. It is to be noted that no matter what signal voltage corresponding to any one of the gradation levels is written in the luminescent pixel 170, the drain current Id is required to be equal to or less than the allowable current. The luminance of the luminescent element 175 becomes higher as the voltage held by the capacitor 174 becomes larger. Thus, the drain current Id must be equal to or less than the allowable current even when the capacitor 174 holds a voltage that corresponds to a signal voltage corresponding to the maximum gradation level. For example, when the signal voltage corresponding to the maximum gradation level is written in the luminescent pixel 170, the voltage held by the capacitor 174 is the above-mentioned gate-source voltage of the drive transistor 173 at which luminescence is produced with the maximum gradation level, that is, 5.6 V.

With Vgs=5.6 V, the back gate-source voltage Vsb at which the drain current Id is equal to or less than 100 pA is defined by Vbs≦−4 V. Thus, Vbs=−4 V is selected as the back gate-source voltage Vbs for writing the signal voltage.

As above, the back gate-source voltage for producing luminance is determined as Vbs=8 V and the source-back gate voltage for writing the signal voltage is determined as Vbs=−4 V.

The high level voltage of the back gate pulses BG (1) to BG (n) is obtained by adding the source voltage to the back gate-source voltage for producing luminescence. The low level voltage of the back gate pulses BG (1) to BG (n) is obtained by adding the source voltage to the back gate-source voltage for writing a signal voltage. Accordingly, in order to determine the high level voltage and the low level voltage of the back gate pulses BG (1) to BG (n), it is necessary to take the source voltage of the drive transistor 173 into account.

Figure 4B:
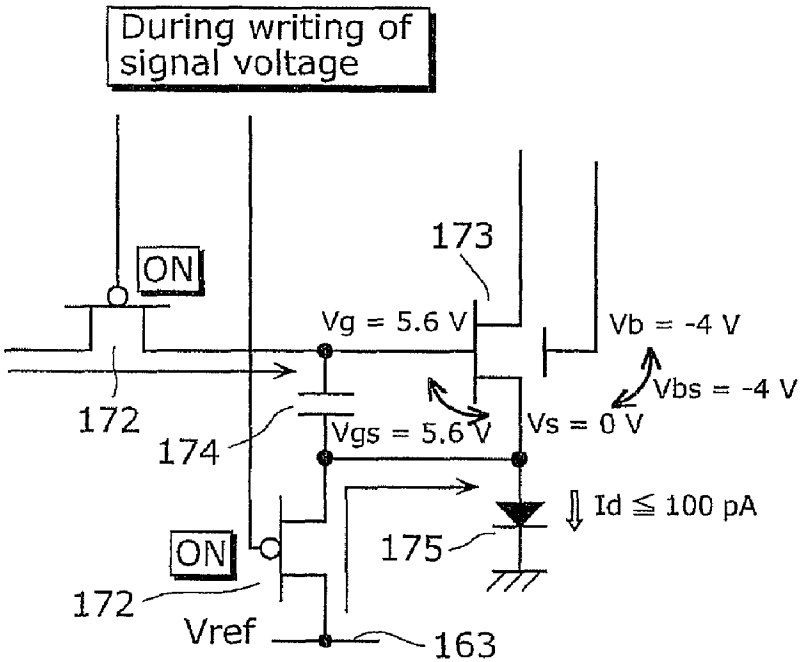
FIG. 4B is a diagram schematically showing a state of a luminescent pixel to which a signal voltage is being written.
Figure 4A:
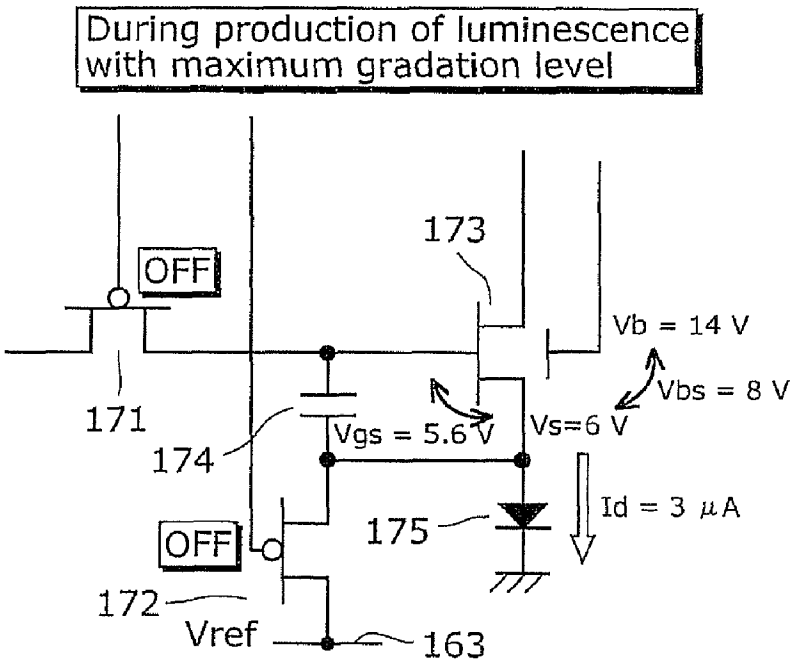
FIG. 4A is a diagram schematically showing a state of a luminescent pixel which is producing luminescence with the maximum gradation level.

FIG. 4A is a diagram schematically showing a state of the luminescent pixel 170 which is producing luminescence with the maximum gradation level. FIG. 4B is a diagram schematically showing a state of the luminescent pixel 170 in which a signal voltage is being written.

When luminescence is being produced with the maximum gradation level as shown in FIG. 4A, the source voltage Vs of the drive transistor 173 will be 6 V with the drain current Id=3 μA as above. With the source voltage Vs of 6 V, the back gate voltage Vb for obtaining characteristics corresponding to Vbs=8 V shown in FIG. 3 is determined by Vb=Vs+Vbs, resulting in Vb=14 V. In sum, the high level voltage of the back gate pulse BG (1) to the back gate pulse BG (n) is determined as 14 V.

On the other hand, when a signal voltage is being written as shown in FIG. 4B, the reset transistor 172 is conducting so that the source of the drive transistor 173 is connected to the reference power line 163 via the reset transistor 172. The source voltage of the drive transistor 173 is therefore the reference voltage Vref, that is, 0 V. With the source voltage Vs of 0 V, the back gate voltage Vb for obtaining characteristics corresponding to Vbs=−4 V shown in FIG. 3 is determined by Vb=Vs+Vbs, resulting in Vb=−4 V. In sum, the low level voltage of the back gate pulse BG (1) to back gate pulse BG (n) is determined as −4 V.

As above, using the Vgs-Id characteristics for each Vbs shown in FIG. 3, the high level voltage of the back gate pulses BG (1) to BG (n) is determined as 14 V from the back gate-source voltage Vbs at such a level as that (Condition i) the luminescent element 175 is supplied with the drain current of 3 μA corresponding to the maximum gradation level when producing luminescence with the maximum gradation level. The low level voltage of the back gate pulses BG (1) to BG (n) is determined as −4 V from the back gate-source voltage Vbs at such a level that (Condition ii) the luminescent element 175 is supplied with the drain current equal to or less than the allowable current when a signal voltage is written. This means that the bias voltage control circuit 130 provides, to the bias lines 165, the back gate pulses BG (1) to BG (n) which have a high level voltage of 14 V, a low level voltage of −4 V, and amplitude of 18 V.

It is to be noted that the source voltage of the drive transistor 173 depends on the amount of the drain current Id. Specifically, the source voltage of the drive transistor 173 is 6 V when luminescence is produced with the maximum gradation (e.g., the gradation level of 255) as described above, but the source voltage of the drive transistor 173 will be 2 V when luminescence is produced with the gradation level of 1. In this case, the Vgs-Id characteristics of the drive transistor 173 of the luminescent pixel 170 producing luminescence with the gradation level of 1 will correspond to Vbs=12 V.

The organic EL display device 100 configured as above includes the reference power line 163 which is a different power line from the first power line 161 and though which the second electrode of the capacitor 174 is set at the predetermined reference voltage Vref. The second electrode, that is on the side of the fixed voltage, of the capacitor 174 is connected to the reference power line 163. Accordingly, for example, when the scan transistor 171 becomes conducting, thereby placing the reset transistor 172 in the conducting state during a period for which a signal voltage is written in the first electrode of the capacitor 174, the voltage held by the capacitor 174, of which second electrode is connected to the reference power line 163, will not be influenced by a voltage drop in the first power line 161, with the result that the voltage held by the capacitor can be prevented from fluctuating.

In this state, for example, the threshold voltage of the luminescent pixel 170 is controlled with the back gate pulses BG (1) to BG (n) so that the drive current, i.e., the drain current Id of the drive transistor 173 stops, and in the state where the drive current is thus suspended, the predetermined reference voltage Vref is applied to the second electrode of the capacitor 174, and a signal voltage is written in the first electrode of the capacitor 174. This makes it possible to prevent fluctuations in the voltage at the second electrode of the capacitor 174 due to flow of the drive current during the period for which a signal voltage is written in the first electrode of the capacitor 174. That is, the capacitor 174 is capable of holding a desired voltage without influence of a voltage drop in the first power line 161, and each of the luminescent elements 170 included in the display unit is capable of producing luminescence with a desired luminance.

In the organic EL display device 100 according to the present embodiment, the back gate electrode of the transistor 173 is used as a switch for the transition between conducting and non-conducting states of the drive transistor 173.

In other words, the bias voltage control circuit 130 controls the threshold voltage of the drive transistor 173 with the back gate pulses BG (1) to BG (n) which are provided to the back gate electrode via the bias line 165. Specifically, the bias voltage control unit 130 provides such back gate pulses BG (1) to BG (n) that stop the drain current of the drive transistor 173 while the data line drive circuit 120 writes a signal voltage at the first electrode of the capacitor 174 through the data line 166 by placing the scan transistor 171 in the conducting state. In the above, stopping the drain current of the drive transistor 173 indicates that the drain current becomes equal to or less than the allowable current.

This means that the voltage of the back gate pulses BG (1) to BG (n) at which the drain current of the drive transistor 173 stops is a voltage which makes the threshold voltage of the drive transistor 173 higher than the gate-source voltage of the drive transistor 173 during the period for which a signal voltage is written. The voltage of the back gate pulses BG (1) to BG (n) at which the drain current of the drive transistor 173 stops may therefore be referred to as bias voltage hereinbelow.

The organic EL display device 100 according to the present embodiment is capable of causing the transition of the drive transistor 173 between conducting and non-conducting states by the back gate pulses BG (1) to BG (n) which are provided from the bias voltage control circuit 130. In other words, as the transition of the drive transistor 173 between the conducting and non-conducting states is controlled through control of the bias voltage to be provided, the back gate electrode can be used as a switching element. This eliminates the need of providing another switching element for cutting the drive current off during the period for which a signal voltage is written. As a result, it is possible to simplify the circuitry design of the luminescent pixel 170 and thereby reduce the production cost.

Next, operations of the above organic EL display device 100 are described.

Figure 5:
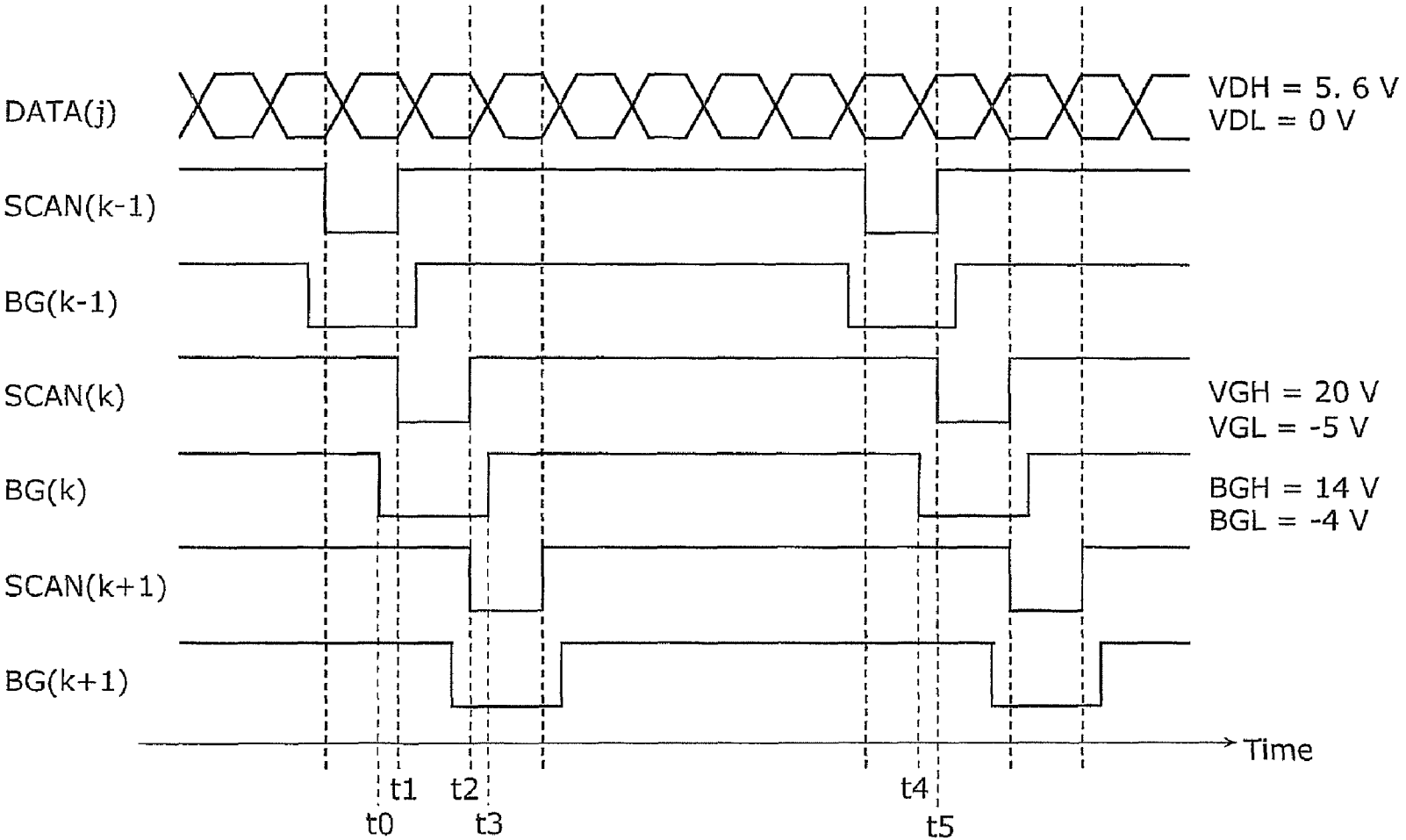
FIG. 5 is a timing chart showing operations of the organic EL display device.

FIG. 5 is a timing chart showing the operations of the organic EL display device 100 according to the first embodiment, and specifically, it mainly shows operations of the luminescent pixel 170 located in the "k"-th row and "j"-th column shown in FIG. 2. In FIG. 5, the horizontal axis represents time, and the vertical axis represents, in the order from top, a data line voltage DATA (j) which is provided to the data line 166 for the luminescent element 170 in the "j"-th column, a scan pulse SCAN (k−1) which is provided to the scan line 164 for the luminescent element 170 in the "k−1"-th row, a back gate pulse BG (k−1) which is provided to the bias line 165 for the luminescent element 170 in the "k−1"-th row, and furthermore, a scan pulse SCAN (k), a back gate pulse BG (k), a scan pulse SCAN (k+1), and a back gate pulse BG (k+1) which are provided to the respective luminescent pixels in the "k"-th and "k+1"-th rows.

Assume, for example, that a data line voltage VDH corresponding to the signal voltage with the maximum gradation level is 5.6 V, and the data line voltage VDL corresponding to the signal voltage with the minimum gradation level (e.g., the gradation level 0) is 0 V. In addition, assume that the scan pulses SCAN (1) to SCAN (n) have a high level voltage VGH of 20 V and a low level voltage VGL of −5 V, for example. Furthermore, as determined with reference to FIG. 3, assume that the back gate pulses BG (1) to BG (n) have a high level voltage BGH of 14 V and a low level voltage BGL of −4 V.

Before time t0, the scan pulse SCAN (k) and the back gate pulse BG (k) are at high level, which means that the luminescent pixels 170 in the "k"-th row produce luminescence according to a signal voltage obtained in the last frame period.

Next, at time t0, the back gate pulse BG (k) transits from high level to low level, which decreases the back gate voltage of the drive transistor 173 from Vb=14 V to Vb=−4 V. That is, the threshold voltage of the drive transistor 173 is set such that even when the signal voltage corresponding to the maximum gradation level is written in the luminescent pixel 170, the drain current of the drive transistor 173 remains no more than the allowable current. In other words, the threshold voltage of the drive transistor 173 is set to be higher than the voltage which is held by the capacitor 174 in the case where the signal voltage corresponding to the maximum gradation level is written in the luminescent element 170.

Next, at time t1, the scan pulse SCAN (k) transits from high level to low level, which switches the scan transistor 171 on. This allows conduction between the data line 166 and the first electrode of the capacitor 174, with the result that the data line voltage DATA (j) is provided to the first electrode of the capacitor 174. At the same time, the reset transistor 172 turns on. This allows conduction between the reference power line 163 and the second electrode of the capacitor 174. With the reference power line 163 having the reference voltage Vref of 0 V, the second electrode of the capacitor 174 has a voltage of 0 V.

For example, when the data line voltage DATA (j) is 5.6 V, the back gate-source voltage is Vbs=−4 V and the gate-source voltage is Vgs=5.6 V as shown in FIG. 4B. In this case, the drain current Id corresponding to Vgs=5.6 V is 100 pA with reference to the Vgs-Id characteristics of Vbs=−4 V as shown in FIG. 3. Thus, the drain current Id is equal to or less than the allowable current, so that a voltage drop in the third power line 163 can be sufficiently prevented during the writing period. This allows the capacitor 174 to hold a voltage which corresponds to the signal voltage, without influence of a voltage drop in the third power line 163.

Next, at time t2, the scan pulse SCAN (k) transits from low level to high level, which switches the scan transistor 171 and the reset transistor 172 off. Consequently, the capacitor 174 holds the voltage applied immediately before the time t2. This means that the capacitor 174 holds the voltage which corresponds to the signal voltage, without influence of a voltage drop in the first power line 161.

As seen from the above, the period from time t1 to time t2 is a period for which a signal voltage is written. In this period for which a signal voltage is written, the back gate pulse BG (k) stays at low level, which keeps the drain current Id of the drive transistor 173 equal to or less than the allowable current even when the first electrode of the capacitor 174 is supplied with the signal voltage corresponding to the maximum gradation level. Thus, in the state where the drain current Id is suspended, the voltage Vref=0 V is provided to the second electrode of the capacitor 174, which makes it possible to prevent the voltage at the second electrode of the capacitor 174 from fluctuating by the drain current Id flowing during the period for which a signal voltage is written.

Because the signal voltage increases as the gradation level increases, it is obvious that the drain current Id of the drive transistor 173 is equal to or less than the allowable current even when the signal voltage corresponding to a gradation level other than the maximum gradation level is provided to the first electrode of the capacitor 174.

Next, at time t3, the back gate pulse BG (k) transits from low level to high level, with the result that the back gate voltage of the drive transistor 173 increases from Vb=−4 V to Vb=12 V. The threshold voltage of the drive transistor 173 therefore becomes lower, so that the drain current Id corresponding to the voltage held by the capacitor 174, which voltage corresponds to the signal voltage, is provided to the luminescent element 175 which thereby starts to produce luminescence. For example, in the case where the signal voltage is 5.6 V, the voltage held by the capacitor 174, which is the difference between the signal voltage and the reference voltage Vref (e.g., 0 V), is 5.6 V, and with reference to FIG. 3, the drain current Id is 3 μA, which causes the luminescent element 175 to produce luminescence with a luminance corresponding to the maximum gradation level.

After this, in the period from time t3 to t4, the back gate pulse BG (k) stays at high level, which allows the luminescent element 175 to keep producing luminescence. As seen from the above, the period from time t3 to time t4 is a period for which luminescence is produced.

Next, at time t5, as in the case of time t1, the scan pulse SCAN (k) transits from high level to low level, which switches the scan transistor 171 on. This allows conduction between the data line 166 and the first electrode of the capacitor 174, with the result that the data line voltage DATA (j) is provided to the first electrode of the capacitor 174. At the same time, the reset transistor 172 turns on. This allows conduction between the reference power line 163 and the second electrode of the capacitor 174. With the reference power line 163 having the reference voltage Vref of 0 V, the second electrode of the capacitor 174 has a voltage of 0 V.

The above-described period from time t1 to time t5 corresponds to one frame period of the organic EL display device 100, and the same operations as those from time t1 to time t5 are repeated after time t5.

As above, the organic EL display device 100 sets the back gate pulse BG (k) at low level to make the drain current of the drive transistor 173 equal to or less than the allowable current, and sets, in this state, the reference voltage Vref=0 V for the second electrode of the capacitor 174, and furthermore provides the signal voltage to the first electrode of the capacitor 174. By so doing, the reference voltage is set for the second electrode of the capacitor 174 and the signal voltage is provided to the first electrode of the capacitor 174 with the drain current suspended, which can prevent fluctuations in voltage of the second electrode of the capacitor 174 due to the drain current Id flowing during the period for which the signal voltage is provided. As a result, in the period from time t3 to time t4 for which luminescence is produced, the luminescent element 170 can produce luminescence with a desired luminance. It is to be noted that when the drain current of the drive transistor 173 is equal to or less than the allowable current, the drive transistor 173 is substantially non-conducting.

As above, the organic EL display device 100 according to the present embodiment includes: the plurality of pixel units 170 arranged in a matrix, wherein each of the pixel units 170 includes: the luminescent element 175 including the first electrode and the second electrode; the capacitor 174 for holding a voltage; the drive transistor 173 having the gate electrode connected to the first electrode of the capacitor 174 and the source electrode connected to the second electrode of the capacitor 174, and allowing a drive current corresponding to the voltage held by the capacitor 174 to flow to the luminescent element 175 to cause the luminescent element 175 to produce luminescence, the drive transistor 173 having the back gate electrode to which the low level voltage BGL of the back gate pulses BG (1) to BG (n) is provided to place the drive transistor 173 in a non-conducting state; the first power line 161 electrically connected to the source electrode of the drive transistor 173 via the luminescent element 175; the second power line 162 electrically connected to the drain electrode of the drive transistor 173; the reference power line 163 which is different from the first power line 161, for setting the predetermined reference voltage Vref for the second electrode of the capacitor 174; the data line 166 for providing a signal voltage; the scan transistor 171 having one terminal connected to the data line 166 and the other terminal connected to the first electrode of the capacitor 174, and selecting conduction or non-conduction between the data line 166 and the first electrode of the capacitor 171; the reset transistor 172 having one terminal connected to the second electrode of the capacitor 174 and the other terminal connected to the reference power line 163, and selecting conduction or non-conduction between the second electrode of the capacitor 174 and the reference power line 163; and the bias line for providing the low level voltage BGL to the back gate electrode, and the organic EL display device further includes the write drive circuit 110 and the bias voltage control circuit 130 which control the scan transistor 171, the reset transistor 172, and the bias voltage that is provided to the back gate electrode, the low level voltage BGL is provided so that an absolute value of a threshold voltage of the drive transistor 173 is larger than a voltage between the gate electrode and the source electrode of the drive transistor 173, and the bias voltage control circuit 130 (i) provides the low level voltage BGL to the back gate electrode so that the threshold voltage of the drive transistor 173 is larger than the voltage between the gate electrode and the source electrode, to place the drive transistor 173 in the non-conducting state, and (ii) sets the predetermined reference voltage Vref for the second electrode of the capacitor 174 and concurrently provides the signal voltage to the first electrode of the capacitor 174 when the drive transistor 173 is in the non-conducting state, by placing the scan transistor 171 and the reset transistor 172 in a conducting state within a period during which the low level voltage BGL is provided.

If the second electrode of the capacitor 174 is directly connected to the first power line 161, the voltage held by the capacitor 174 will fluctuate due to influence of a voltage drop in the first power line 161.

The present embodiment therefore provides the reference power line 163 which is a different power line from the first power line 161 and though which the second electrode of the capacitor 174 is set at the predetermined reference voltage Vref. The second electrode, that is on the side of the fixed voltage, of the capacitor 174 is disconnected from the first power line 161 and connected to the reference power line 163. As a result, since the second electrode of the capacitor 174 is connected to the reference power line 163 during the period for which a signal voltage is written, it is possible to prevent a voltage drop in the first power line 161 from influencing the second electrode of the capacitor 174 and thus prevent fluctuations in the voltage held by the capacitor 174.

With this, in the present embodiment, the back gate electrode is used to stop the drain current Id of the drive transistor 173 and in the state where the drive current Id is suspended, the predetermined reference voltage Vref is set for the second electrode of the capacitor 174, and a signal voltage is provided to the first electrode of the capacitor 174. Thus, with the drain current Id suspended, the predetermined reference voltage Vref is set for the second electrode of the capacitor 174 while the signal voltage is provided to the first electrode of the capacitor 174, so that during the period for which the signal voltage is provided, no drain current Id flows, and it is therefore possible to prevent fluctuations in the voltage of the second electrode of the capacitor 174 during the period for which a signal voltage is provided. As a result, the capacitor 174 is capable of holding a desired voltage, and the luminescent pixel 170 included in the display unit is thus capable of producing luminescence with a desired luminance.

In the present embodiment, the back gate electrode of the transistor 173 is used as a switch for causing the transition of the drive transistor 173 between conducting and non-conducting states. The low level voltage BGL is applied to the back gate electrode so that the threshold voltage of the drive transistor 173 is larger than the voltage between the gate electrode and the source electrode of the drive transistor 173. As the transition of the drive transistor 173 between the conducting and non-conducting states is controlled through control of the bias voltage to be provided, the back gate electrode can be used as a switching element. This eliminates the need of providing another switching element for cutting the drive current off during the period for which a signal voltage is written.

That is, the drive transistor 173 undergoes the transition between conducting and non-conducting according to the back gate pulse BG (k) which is provided to the back gate electrode of the drive transistor 173. Specifically, the low level voltage (BGL=−4 V) of the back gate pulse BG (k) is provided so that the threshold voltage of the drive transistor 173 becomes higher than the gate-source voltage of the drive transistor 173. The high level voltage (BGH=14 V) of the back gate pulse BG (k) is provided so that the threshold voltage of the drive transistor 173 becomes lower than the gate-source voltage of the drive transistor 173. The organic EL display device 100 is thus capable of controlling the transition of the drive transistor 173 between conducing and non-conducting states with the back gate pulse BG (k). In other words, the back gate electrode of the drive transistor 173 is used as a switching element.

The organic EL display device 100 is therefore capable of causing a luminescent pixel to produce luminescence with a desired luminance without an additional switching element for cutting the drain current Id off during the period for which a signal voltage is written.

In sum, the organic EL display device 100 according to the present embodiment is capable of causing the display unit 180 to produce luminescence with a desired luminance, while each of the luminescent pixels 170 included in the display unit 180 is provided with a simplified structure.

The trunk power line 190 is disposed on a periphery of the display unit 180, and the second power lines 162 branch from the trunk power line 190 so as to correspond to the respective rows and columns of the multiple luminescence pixels 170, thereby forming a grid pattern. The periphery of the display unit 180 indicates a region between the outer edge of the display panel 160 and the outer boundary of the minimum region which includes all the multiple luminescent pixels 170 arranged in a matrix.

In this case, the total resistance of the second power lines 162 is smaller for the second power lines 162 extending along the columns, as compared to the case where the second power lines 162 branching from the trunk power line 190 do not extend along the columns but extend only along the rows. Accordingly, the present embodiment reduces the voltage drops which occur in the second power lines 162. It is therefore possible to reduce the fixed voltage Vdd which is provided from the DC power supply 150, and thereby reduce the power consumption.

Furthermore, in the organic EL display device 100, from time t1 to time t2 in FIG. 5, a signal voltage is provided to the first electrode of the capacitor 174 and then, at time t2, the scan transistor 171 undergoes the transition to non-conduction. Subsequently, at time t3, the high level voltage (BGH=14 V) of the back gate pulse BG (k) higher than the low level voltage (BGL=−4 V) of the back gate pulse BG (k) is provided to the back gate electrode so that the threshold voltage of the drive transistor 173 becomes lower than the gate-source voltage, which causes the transition of the drive transistor 173 to the conducting state, and the drain current Id corresponding to the voltage held by the capacitor 174 is allowed to flow to the luminescent element 175 and thereby causes it to start to produce luminescence.

Specifically, in the case where the drive transistor 173 is an N-type transistor as in the present embodiment, a signal voltage is provided to the first electrode of the capacitor 174, and the back gate electrode of the drive transistor 173 is then supplied with the high level voltage of the back gate pulse BG (k), which is a reverse bias voltage higher than the low level voltage of the back gate pulse BG (k) that is a predetermined bias voltage. This causes the transition of the drive transistor 173 from the non-conducting state to the conducting state, which allows the drain current Id corresponding to the voltage held by the capacitor 174 to flow to the luminescent element 175 and thereby causes the luminescent element 175 to produce luminescence.

This makes it possible to prevent the voltage drop which occurs due to the drain current Id flowing during the period for which a signal voltage is written, so that the capacitor 174 is capable of holding a desired voltage. As a result, the drive transistor 173 is capable of allowing the drain current Id corresponding to the desired voltage to flow and thereby causing the luminescent element 175 to produce luminescence.

The scan transistor 171 and the reset transistor 172 each undergo the transition between conducting and non-conducting with the scan pulses SCAN (1) to SCAN (n) which are provided through the scan line 164 which is the common for the scan transistor 171 and the reset transistor 172. This allows a reduction in the number of wiring channels in the display unit 180, which can simplify the circuitry design.

The reference voltage Vref which is provided from the reference power line 163 is equal to or lower than the voltage of the first power line.

Accordingly, while the reference voltage Vref is set for the second electrode of the capacitor 174, the voltage at the anode of the luminescent element 175 is equal to or lower than the voltage at the cathode thereof, so that no current flows from the reference power line 163 to the luminescent element 175. As a result, it is possible to prevent a decrease in contrast which is due to unnecessary production of luminescence during the period for which a signal voltage is written. While the reference voltage Vref is 0 V and the voltage of the first power line is 0 V in the above description, they are an example and not limited to the above values as long as the reference voltage Vref is equal to or lower than the voltage of the first power line.

Variation of First Embodiment

The organic EL display device according to the present variation is almost the same as the organic EL display device 100 according to the first embodiment except that the period for which a predetermined bias voltage is provided to the back gate electrode of the drive transistor 173 is set to be the same as the period for which a signal voltage is provided to the first electrode of the capacitor 174 and that the scan line 164 and the bias line 165 are provided as a common control line.

The following specifically describes the variation of the first embodiment, especially differences thereof from the first embodiment, with reference to the drawings.

Figure 6:
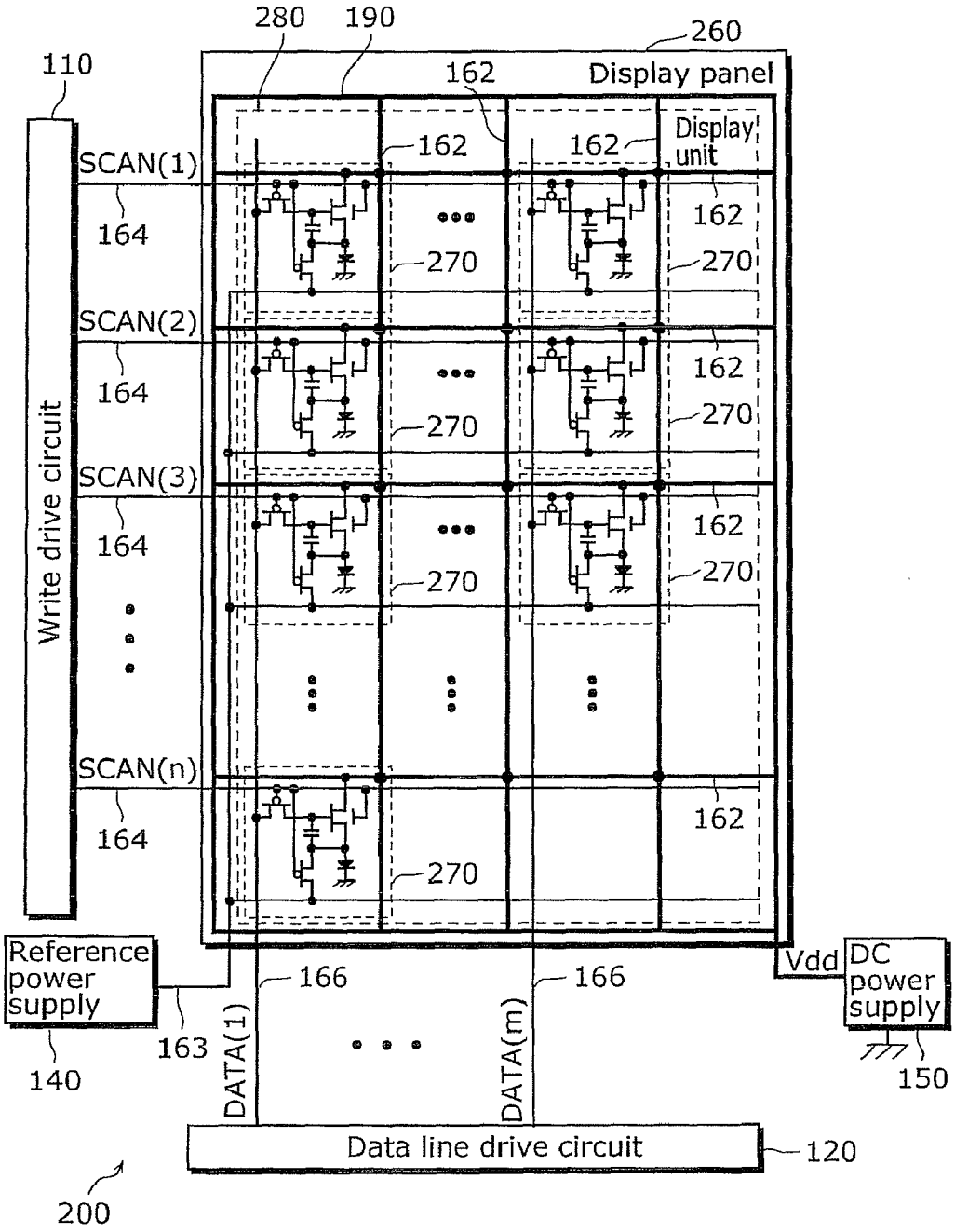
FIG. 6 is a block diagram showing a configuration of an organic EL display device according to a variation of the first embodiment.
Figure 7:
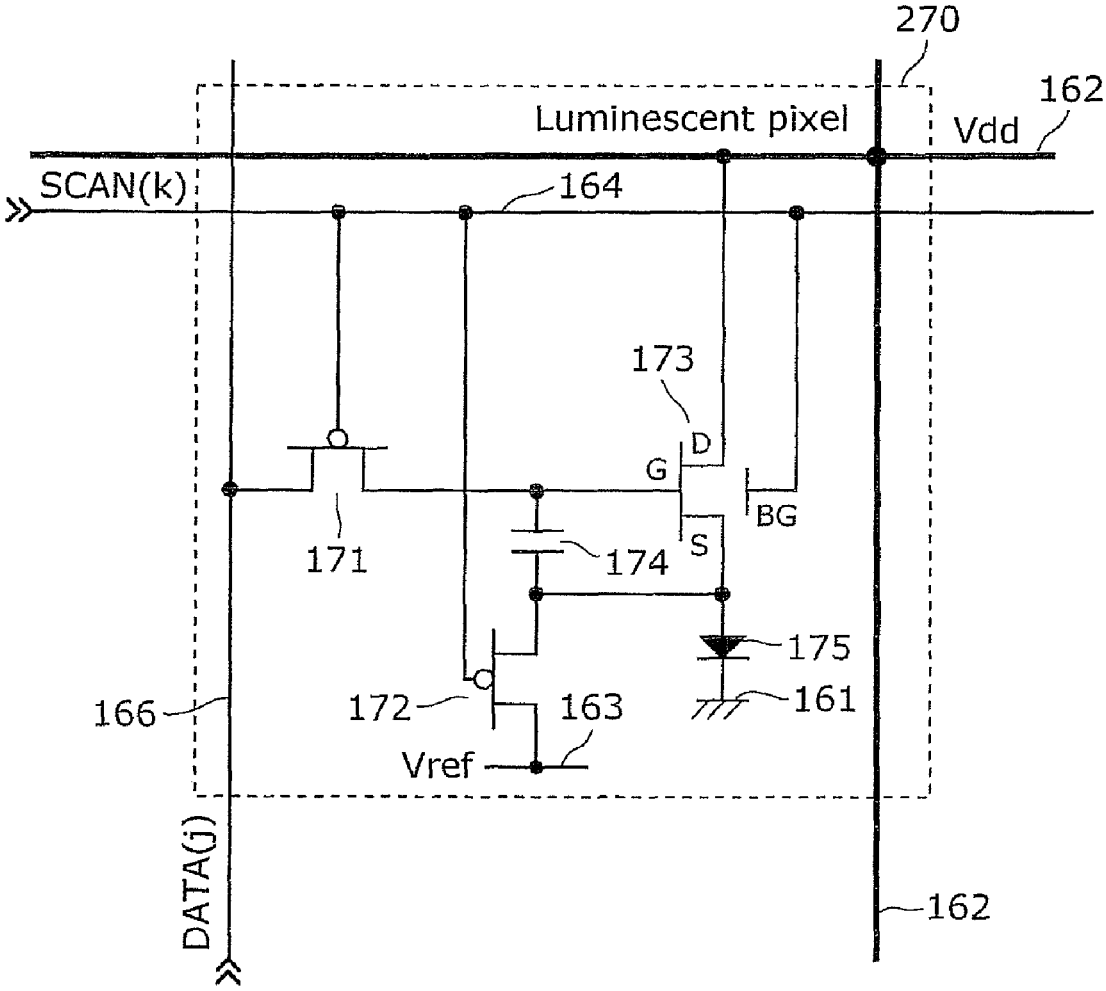
FIG. 7 is a circuit diagram showing a detailed circuitry design of a luminescent pixel.

FIG. 6 is a block diagram showing a configuration of the organic EL display device according to the present variation, and FIG. 7 is a circuit diagram showing a detailed circuitry design of a luminescent pixel included in the organic EL display device according to the present variation.

As shown in FIG. 6, unlike the organic EL display device 100 according to the first embodiment shown in FIG. 1, an organic EL display device 200 according to the present variation does not include the bias voltage control circuit 130 and the bias lines 165, and includes luminescent pixels 270 instead of the luminescent pixels 170. Furthermore, the organic EL display device 200 includes, instead of the display panel 160, a display panel 260 that includes a display unit 280 in which the multiple luminescent pixels 270 are arranged.

As shown in FIG. 7, in each of the luminescent pixels 270, unlike the luminescent pixel 170, the back gate electrode of the drive transistor 173 is connected to the scan line 164. This means that the organic EL display device 200 according to the present variation, which requires no bias lines 165 unlike the display device 100 according to the first embodiment, has the reduced number of wiring channels, thus allowing for a simplified circuitry design.

Figure 8:
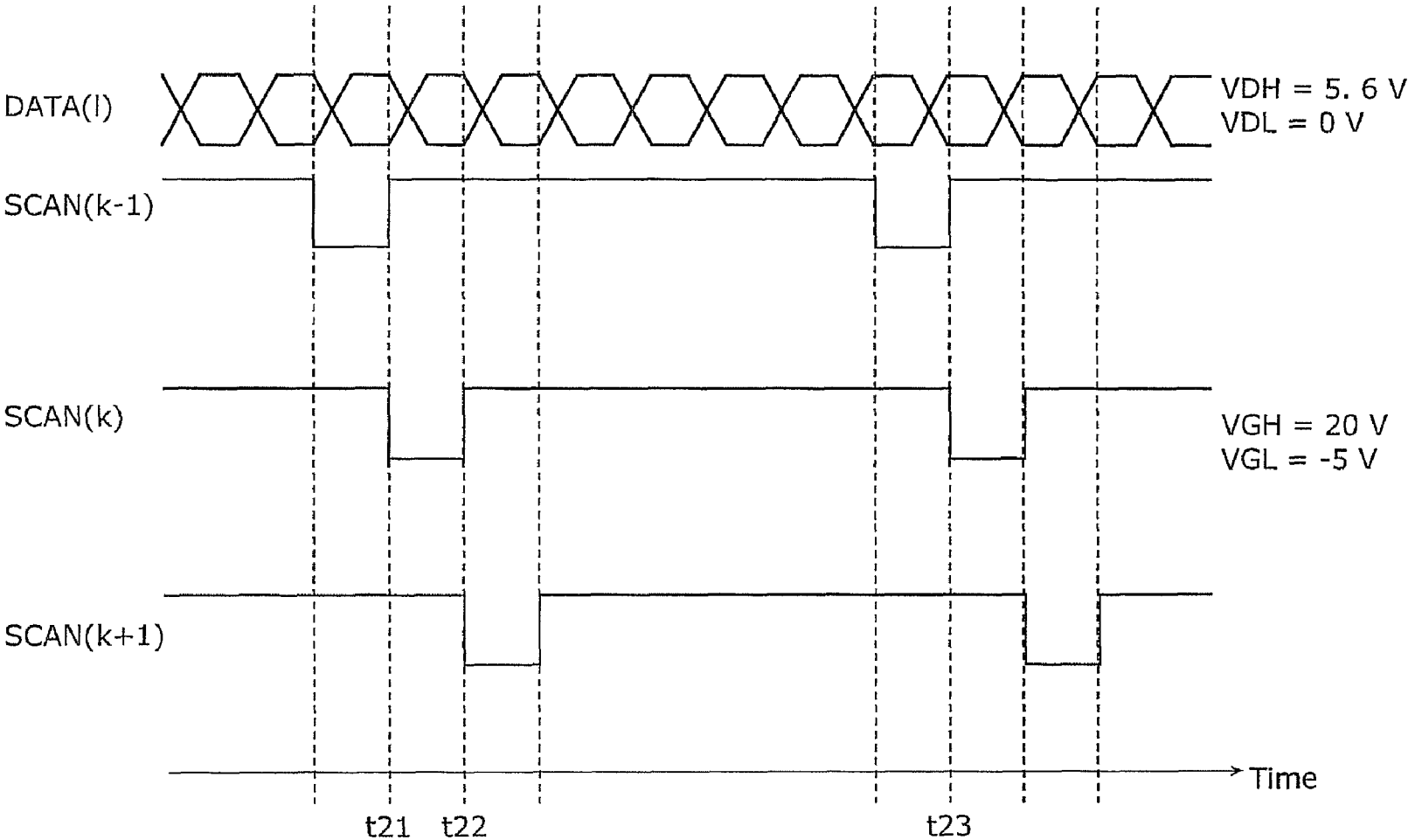
FIG. 8 is a timing chart showing operations of the organic EL display device.

FIG. 8 is a timing chart showing operations of the organic EL display device 200 according to the variation of the first embodiment. Specifically, it mainly shows operations of the luminescent pixel 270 located in the "k"-th row and "j"-th column shown in FIG. 6.

First, at time t21, the scan pulse SCAN (k) transits from high level to low level, which switches the scan transistor 171 and the reset transistor 172 on.

Assume that the scan pulse SCAN (k) has a high level voltage VGH of 20 V and a low level voltage VGL of −5 V. Accordingly, the transition of the scan pulse SCAN (k) from high level to low level decreases the back gate voltage of the drive transistor 173 from Vb=20 V to Vb=−5 V. That is, the threshold voltage of the drive transistor 173 is set such that even when the signal voltage corresponding to the maximum gradation level is written in the luminescent pixel 270, the drain current of the drive transistor 173 remains no more than the allowable current. In other words, the low level voltage VGL of the scan pulse SCAN (k) is such a voltage that the threshold voltage of the drive transistor 173 becomes higher than the voltage which is held by the capacitor 174 in the case where the signal voltage corresponding to the maximum gradation level is written in the luminescent element 270.

In sum, unlike the organic EL display device 100 according to the first embodiment, the organic EL display device 200 according to the present variation does not include the bias lines 165 for setting the voltage at the back gate electrode of the drive transistor 173 to the predetermined bias voltage, but uses, as the predetermined bias voltage, the low level voltage VGL of the scan pulse SCAN (k) which is provided to the scan lines 164.

Next, at time t22, the scan pulse SCAN (k) transits from low level to high level, which switches the scan transistor 171 and the reset transistor 172 off.

As seen from the above, the period from time t21 to time t22 is a period for which a signal voltage is written. In this period for which a signal voltage is written, the voltage which is provided to the back gate electrode of the drive transistor 173 keeps being the low level voltage VGL of the scan pulse SCAN (k), which keeps the drain current Id of the drive transistor 173 equal to or less than the allowable current even when the first electrode of the capacitor 174 is supplied with the signal voltage corresponding to the maximum gradation level. As in the case of the organic EL display device 100 according to the first embodiment, the organic EL display device 200 according to the present variation is capable of preventing the voltage at the second electrode of the capacitor 174 from fluctuating during the period for which a signal voltage is written.

At time t22, the back gate voltage Vb of the drive transistor 173 becomes 20 V, in the case where the high level voltage (VGH=20 V) of the scan pulse SCAN (k) is provided. As described in the first embodiment, when the luminescent element 175 is producing luminescence with the maximum gradation level, the source voltage of the drive transistor 173 is 6 V and therefore, the back gate-source voltage Vbs of the drive transistor 173 is 14 V. Accordingly, with the Vgs-Id characteristics shown in FIG. 3, it is possible to satisfy the conditions required in the drive transistor 173, namely, Condition i: the luminescent element 175 is supplied with a drain current corresponding to the maximum gradation level when producing luminescence with the maximum gradation level.

That is, in the organic EL display device 200 according to the present variation, the high level voltage VGH of the scan pulse SCAN (k) which is provided to the scan lines 164 is used as the back gate voltage for obtaining the back gate-source voltage at which the drain current Id corresponding to the maximum gradation level flows.

Next, at time t23, as in the case of time t21, the scan pulse SCAN (k) transits from high level to low level, which switches the scan transistor 171 and the reset transistor 172 on. In addition, the back gate voltage of the drive transistor 173 decreases from Vb=20 V to Vb=−5 V.

The above-described period from time t21 to time t23 corresponds to one frame period of the organic EL display device 200, and the same operations as those from time t21 to time t23 are repeated after time t23.

As above, in the organic EL display device 200 according to the present variation, the period for which a predetermined bias voltage (VGL=−5 V) is provided to the back gate electrode of the drive transistor 173 is set to be the same as the period for which a signal voltage is provided to the first electrode of the capacitor 174 and the scan line 164 and the bias line 165 are provided as a common control line, unlike the organic EL display device 100 according to the first embodiment. Specifically, as compared to the first embodiment, the scan line 164 is connected further to the back gate electrode of the drive transistor 173.

Second Embodiment

An organic EL display device according to the second embodiment is almost the same as the organic EL display device 100 according to the first embodiment except that the reference power line for one row and the bias line for a previous row are the same line. The following specifically describes the organic EL display device according to the present embodiment, especially differences thereof from the organic EL display device 100 according to the first embodiment.

Figure 9:
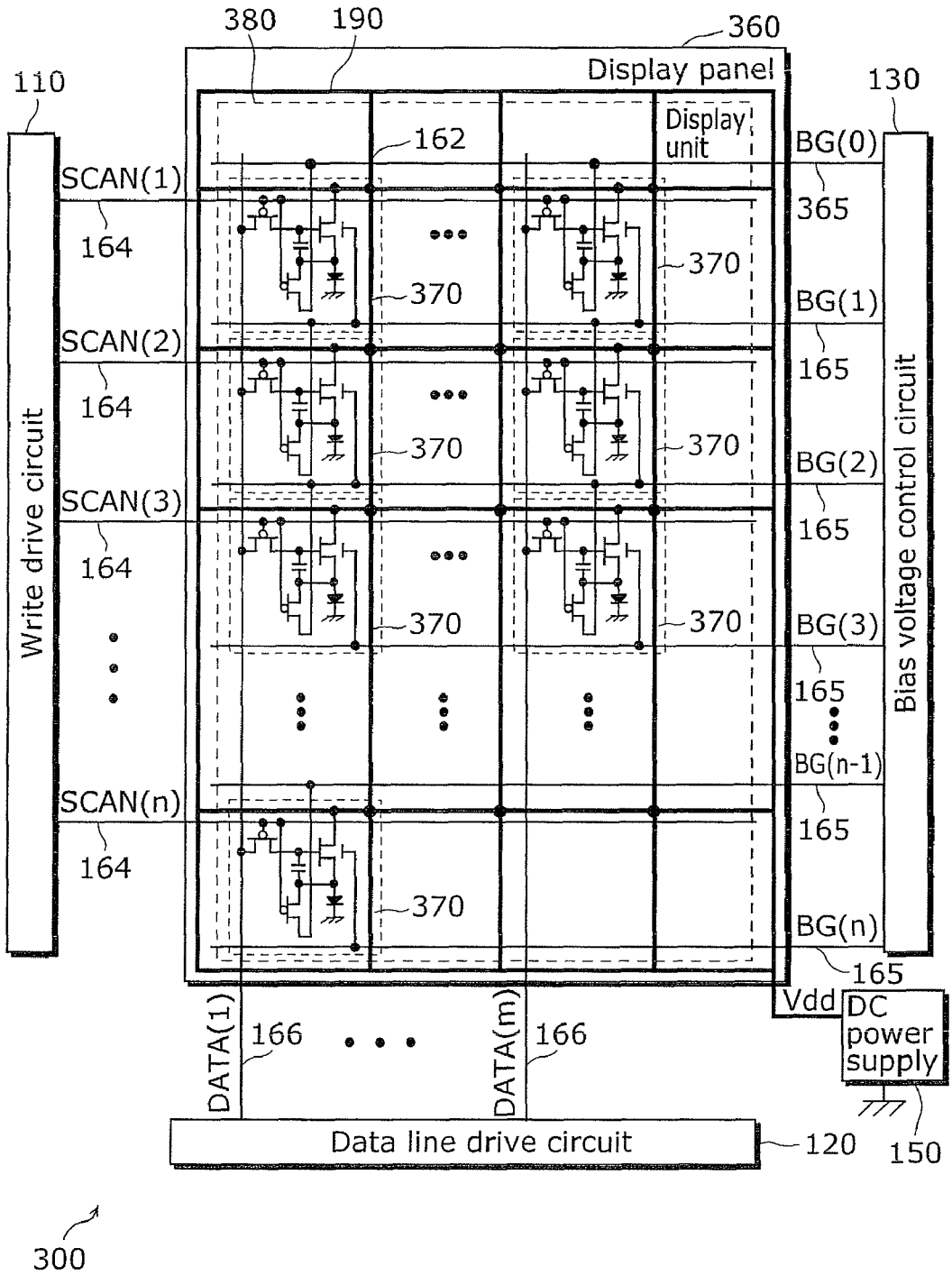
FIG. 9 is a block diagram showing a configuration of an organic EL display device according to the second embodiment.

FIG. 9 is a block diagram showing a configuration of the organic EL display device according to the second embodiment.

In the organic EL display device 300 shown in FIG. 9, unlike the organic EL display device 100 shown in FIG. 1, multiple luminescent pixels 370 arranged in one row are connected to the bias line 165 for the luminescent pixels 370 arranged in a previous row, and the reference power supply 140 for providing the reference voltage Vref is not included, but a dummy bias line 365 is included. Furthermore, the organic EL display device 300 includes, instead of the display panel 160, a display panel 360 that includes a display unit 380 in which multiple luminescent pixels 370 are arranged.

The dummy bias line 365 is connected to the luminescent pixels 370 arranged in the first row of the multiple luminescent pixels 370, and as in the case of the bias line 165, the dummy bias line 365 is supplied with the back gate pulse BG (0), which is one horizontal period earlier than the back gate pulse BG (1), provided from the bias voltage control circuit 130.

Figure 10:
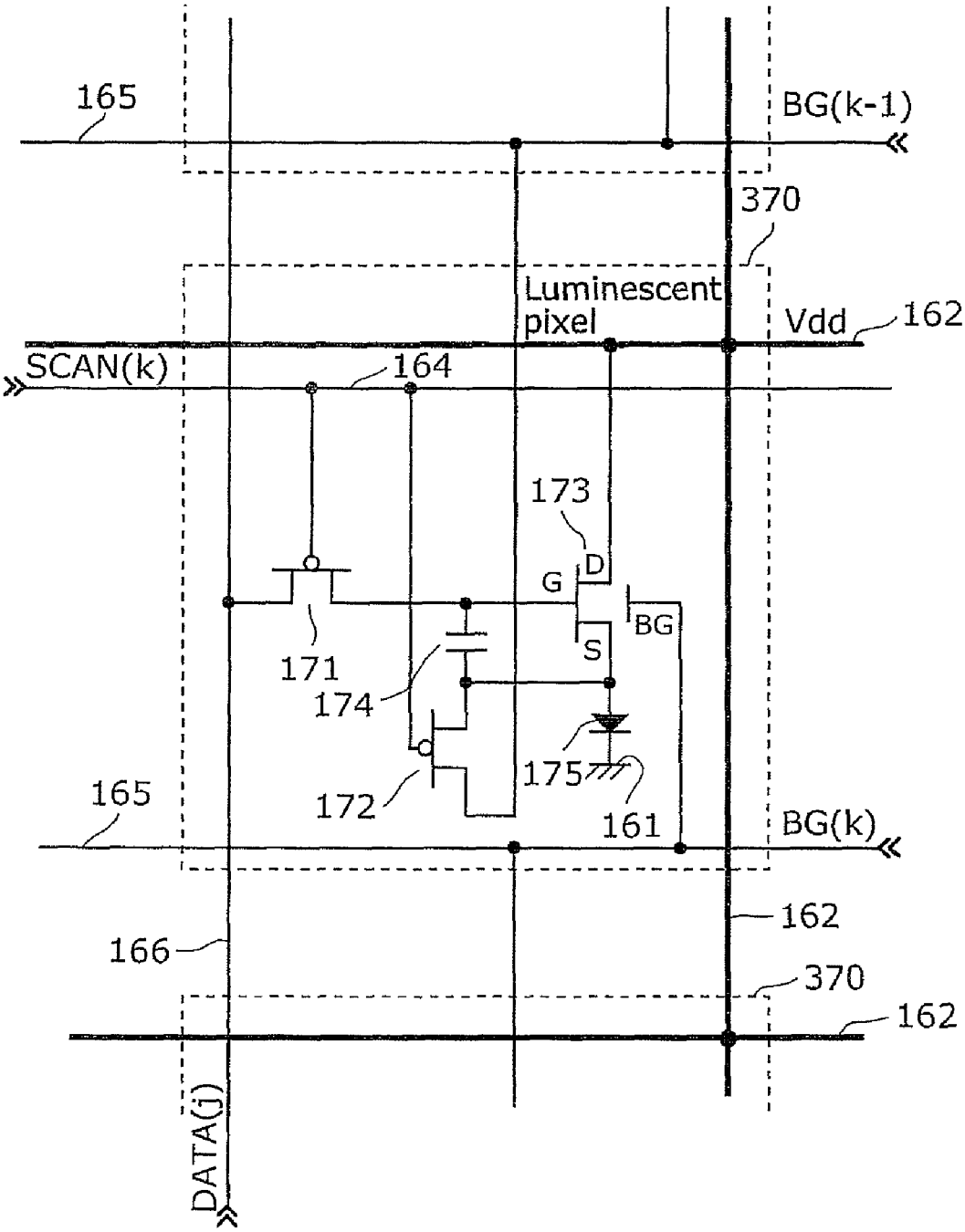
FIG. 10 is a circuit diagram showing a detailed circuitry design of a luminescent pixel.

FIG. 10 is a circuit diagram showing a detailed circuitry design of the luminescent pixel 370 shown in FIG. 9. The luminescent pixel 370 shown in FIG. 10 is the luminescent pixel 370 located in the "k"-th row and "j"-th column, and FIG. 10 includes part of the configuration of the luminescent pixel 370 located in the "k−1"-th row and "j"-th column and part of the configuration of the luminescent pixel 370 located in the "k+1"-th row and "j"-th column.

In the luminescent pixel 370 shown in FIG. 10, unlike the luminescent pixel 170 shown in FIG. 2, the reset transistor 172 is connected to the bias line 165 for the luminescent pixel 370 in a previous row, and the reference power line 163 through which the reference voltage Vref is provided is not included.

In other words, the reference power line for one row and the bias line 165 for a previous row are the same.

This reduces the number of wiring channels and thereby simplifies the circuitry design in the organic EL display device 300 according to the present embodiment, as compared to the organic EL display device 100 according to the first embodiment.

The following describes a determination on values of high level voltages and low level voltages of the back gate pulses BG (0) to BG (n) which are provided from the bias voltage control circuit 130.

The drive transistor 173 of the luminescent pixel 370 requires (Condition i) and (Condition ii) described in the first embodiment. Furthermore, the drain current corresponding to the maximum gradation level is set at 3 μA, and the allowable current during a writing period is set at 100 pA, as in the case of the first embodiment.

Figure 11:
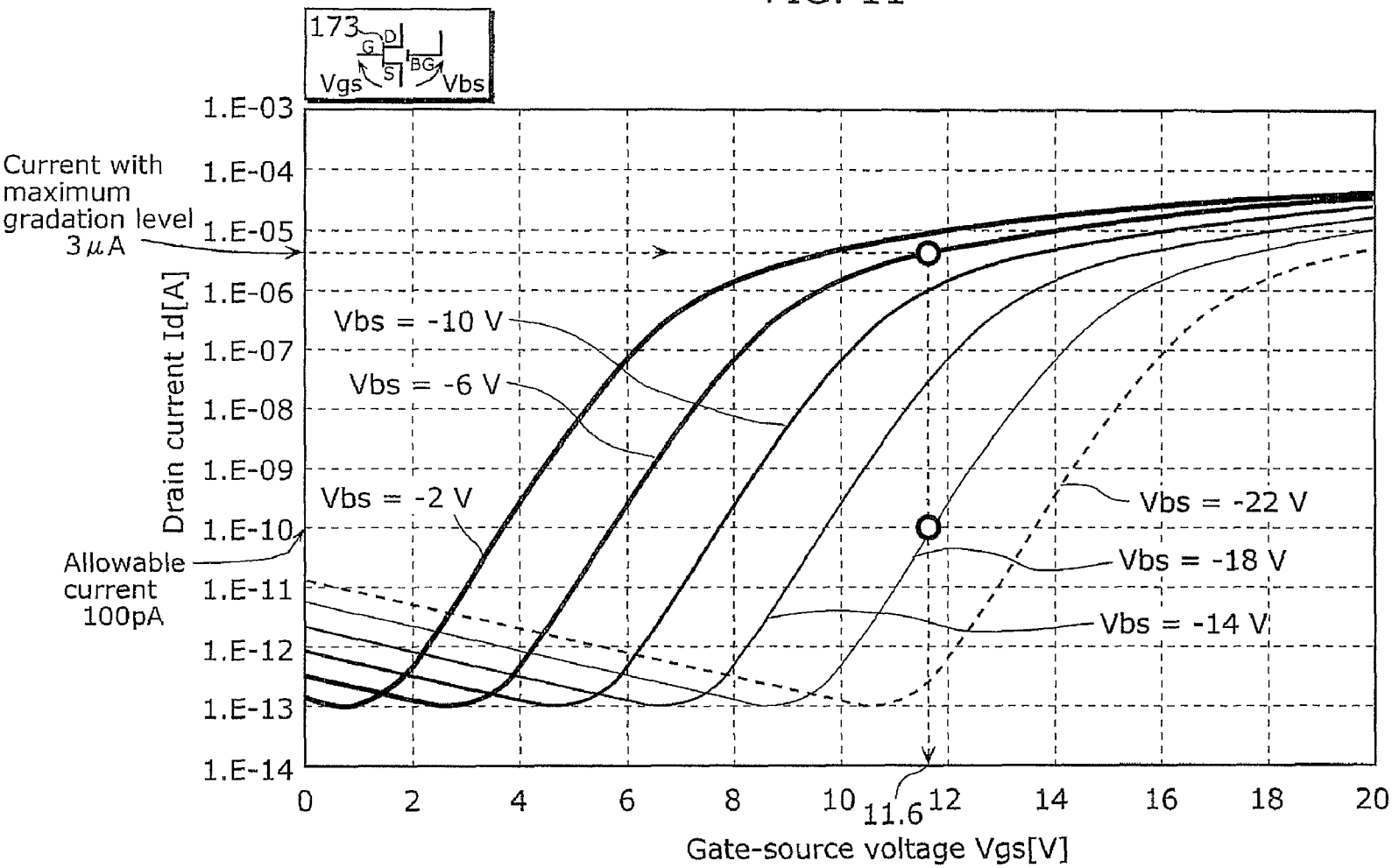
FIG. 11 is a graph showing another example of Vgs-Id characteristics of a drive transistor.

FIG. 11 is a graph showing another example of characteristics of the drain current relative to the gate-source voltage (Vgs-Id characteristics) in the drive transistor 173. The Vgs-Id characteristics shown in FIG. 11 are different from the Vgs-Id characteristics shown in FIG. 3 in the range of Vgs and the back gate-source voltage Vbs. Specifically, FIG. 11 shows the Vgs-Id characteristics with the back gate-source voltages Vbs of −22 V, −18 V, −14 V, −10 V, −6 V, and −2 V.

The following describes the determination on values of high level voltages and low level voltages of the back gate pulses BG (0) to BG (n) using the Vgs-Id characteristics shown in FIG. 11. The determination process is the same as in the first embodiment and therefore will not be described in detail again.

First, Vbs=−6 V is selected as characteristics of the back gate-source voltage for producing luminescence.

Next, the gate-source voltage for producing luminescence with the maximum gradation level is determined. Specifically, since the drain current Id corresponding to the maximum gradation level is 3 μA, the selection of Vbs=−6 V as above leads to Vgs=11.6 V.

Next, the back gate-source voltage Vbs at which the drain current Id is equal to or less than the allowable current in writing of the signal voltage is selected. It is to be noted that no matter what signal voltage corresponding to any one of the gradation levels is written in the luminescent pixel 370, the drain current Id is required to be equal to or less than the allowable current. With Vgs=11.6 V, the back gate-source voltage Vbs at which the drain current Id is equal to or less than 100 pA is defined by Vbs≦−18 V. Thus, Vbs=−18 V is selected as the back gate-source voltage Vbs for writing the signal voltage.

As above, the back gate-source voltage for producing luminance is determined as Vbs=−6 V and the source-back gate voltage for writing the signal voltage is determined as Vbs=−18 V.

The high level voltages of the back gate pulses BG (0) to BG (n) are each obtained by adding the source voltage to the back gate-source voltage for producing luminescence. The low level voltages of the back gate pulses BG (0) to BG (n) are each obtained by adding the source voltage to the back gate-source voltage for writing a signal voltage. Accordingly, in order to determine the high level voltage and the low level voltage of the back gate pulses BG (0) to BG (n), it is necessary to take the source voltage of the drive transistor 173 into account.

Figure 12B:
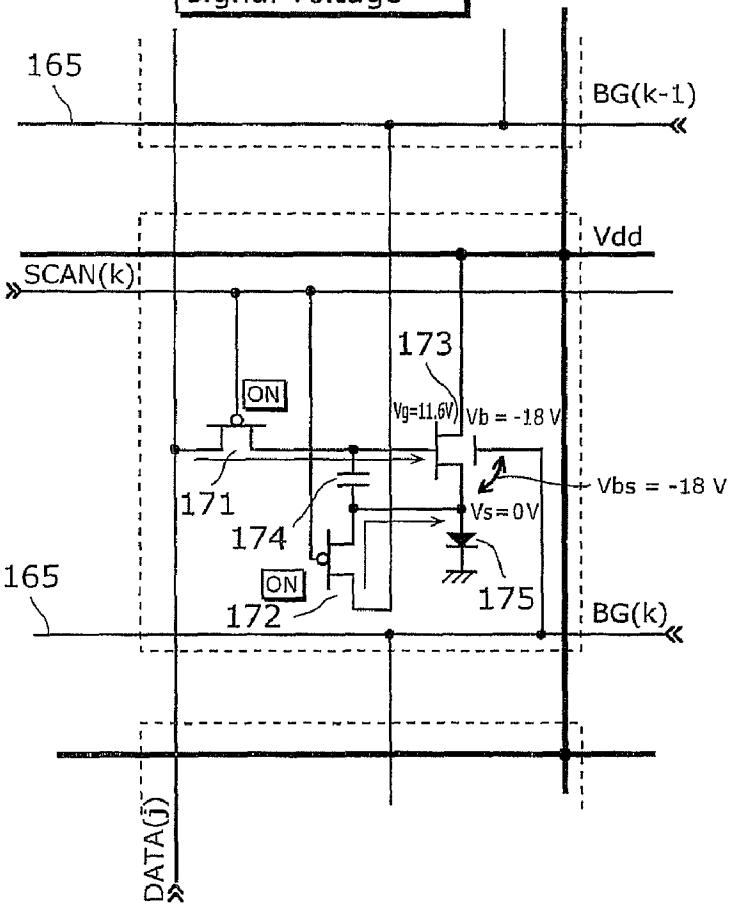
FIG. 12B is a diagram schematically showing a state of a luminescent pixel to which a signal voltage is being written.
Figure 12A:
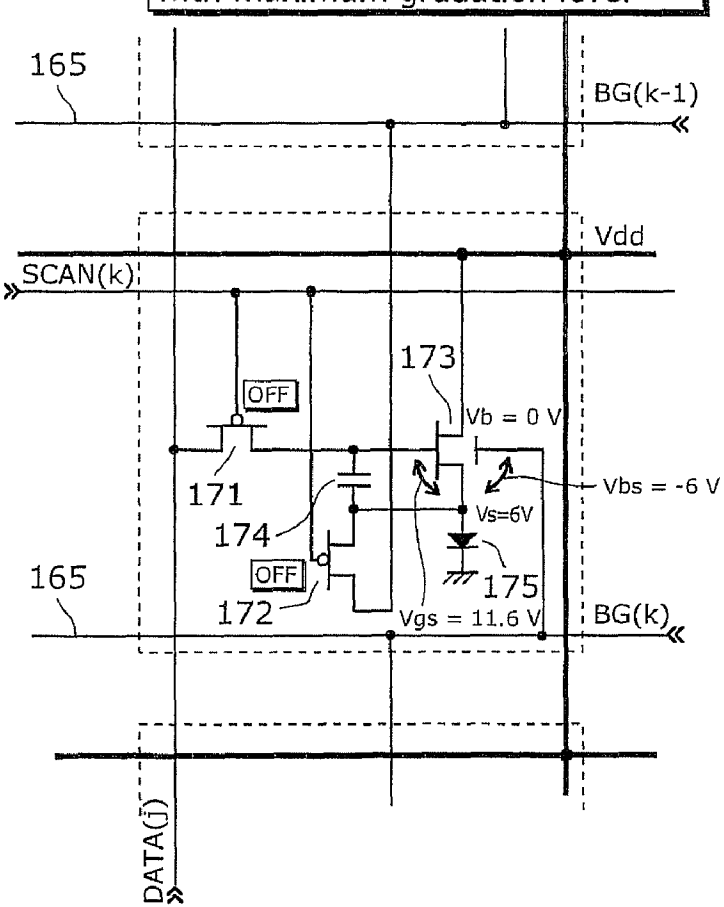
FIG. 12A is a diagram schematically showing a state of a luminescent pixel which is producing luminescence with the maximum gradation level.

FIG. 12A is a diagram schematically showing a state of the luminescent pixel 370 which is producing luminescence with the maximum gradation level. FIG. 12B is a diagram schematically showing a state of the luminescent pixel 370 in which a signal voltage is being written.

When luminescence is being produced with the maximum gradation level as shown in FIG. 12A, the source voltage Vs of the drive transistor 173 will be 6 V with the drain current Id=3 μA as above. With the source voltage Vs of 6 V, the back gate voltage Vb for obtaining characteristics corresponding to Vbs=−6 V shown in FIG. 11 is determined by Vb=Vs+Vbs, resulting in Vb=0 V. In sum, the high level voltage of the back gate pulse BG (0) to the back gate pulses BG (n) is determined as 0 V.

On the other hand, when a signal voltage is being written as shown in FIG. 12B, the reset transistor 172 is conducting so that the source of the drive transistor 173 is connected to the bias line 165 for a previous row via the reset transistor 172. The source voltage of the drive transistor 173 is therefore the voltage of the bias line 165 for the luminescent pixels 370 in "k−1"-th row during the period for which a signal voltage is written in the luminescent pixels 370 in the "k"-th row.

In the period for which a signal voltage is written in the luminescent pixels 370 in the "k"-th row, the back gate pulse BG (k−1) is at high level because the writing of a signal voltage in the luminescent pixels 370 in the "k−1"-th row has been completed. This means that the voltage of the bias line 165 for the luminescent pixels 370 in the "k−1"-th row is 0 V.

Accordingly, the source voltage of the drive transistor 173 of the luminescent pixel 370 in the "k"-th row is 0 V. With the source voltage Vs of 0 V, the back gate voltage Vb for obtaining characteristics corresponding to Vbs=−18 V shown in FIG. 11 is determined by Vb=Vs+Vbs, resulting in Vb=−18 V. In sum, the low level voltage of the back gate pulse BG (0) to back gate pulse BG (n) is determined as −18 V.

As above, using the Vgs-Id characteristics for each Vbs shown in FIG. 11, the high level voltage of the back gate pulses BG (0) to BG (n) is determined as 0 V from the back gate-source voltage Vbs at such a level as that (Condition i) the luminescent element 175 is supplied with the drain current of 3 μA corresponding to the maximum gradation level when luminescence is produced with the maximum gradation level. The low level voltage of the back gate pulses BG (0) to BG (n) is determined as −18 V from the back gate-source voltage Vbs at such a level that (Condition ii) the luminescent element 175 is supplied with the drain current Id equal to or less than the allowable current when a signal voltage is written. This means that, in the present embodiment, the bias voltage control circuit 130 provides, to the bias lines 165 and the dummy bias line 365, the back gate pulses BG (0) to BG (n) which have a high level voltage of 0 V, a low level voltage of −18 V, and amplitude of 18 V.

Next, operations of the above organic EL display device 300 are described.

Figure 13:
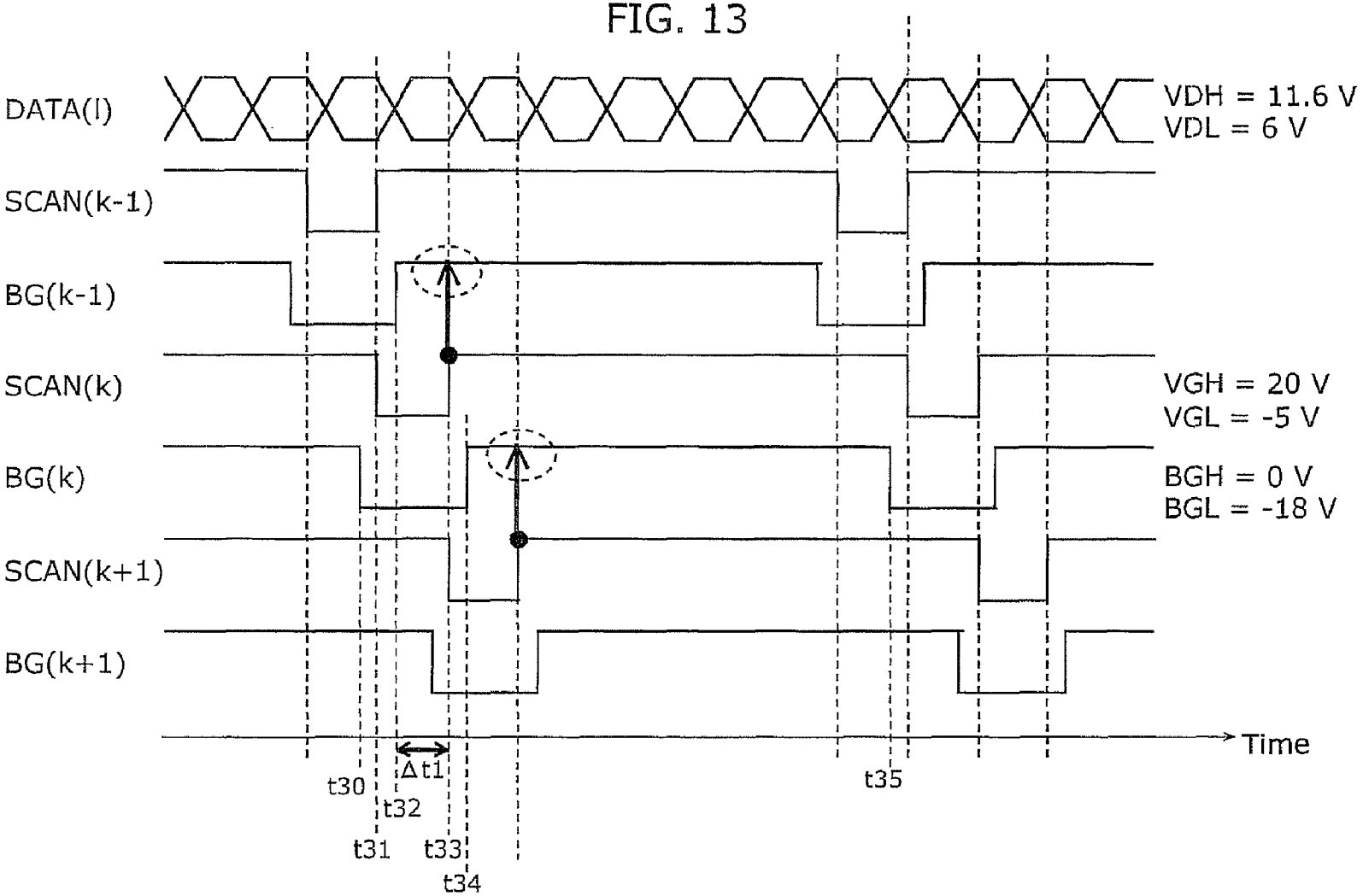
FIG. 13 is a timing chart showing operations of the organic EL display device according to the second embodiment.

FIG. 13 is a timing chart showing the operations of the organic EL display device 300 according to the second embodiment, and specifically, it mainly shows operations of the luminescent pixel 370 located in the "k"-th row and "j"-th column shown in FIG. 10. In FIG. 13, the horizontal axis represents time, and the vertical axis represents, in the order from top, a data line voltage DATA (j) which is provided to the data line 166 for the luminescent element 370 in the "J"-th column, a scan pulse SCAN (k−1) which is provided to the scan line 164 for the luminescent element 370 in the "k−1"-th row, a back gate pulse BG (k−1) which is provided to the bias line 165 for the luminescent element 370 in the "k−1"-th row, and furthermore, a scan pulse SCAN (k), a back gate pulse BG (k), a scan pulse SCAN (k+1), and a back gate pulse BG (k+1) which are provided to the respective luminescent pixels in the "k"-th and "k+1"-th rows.

Assume, for example, that a data line voltage VDH corresponding to the signal voltage with the maximum gradation level is 11.6 V, and the data line voltage VDL corresponding to the signal voltage with the minimum gradation level is 6 V. In addition, assume that the scan pulses SCAN (1) to SCAN (n) have a high level voltage VGH of 20 V and a low level voltage VGL of −5 V. Furthermore, as determined with reference to FIG. 11, assume that the back gate pulses BG (0) to BG (n) have a high level voltage BGH of 0 V and a low level voltage BGL of −18 V.

Before time t30, the scan pulse SCAN (k) and the back gate pulse BG (k) are at high level, which means that the luminescent pixels 370 in the "k"-th row produce luminescence according to a signal voltage obtained in the last frame period.

Next, at time t0, the back gate pulse BG (k) transits from high level to low level, which decreases the back gate voltage of the drive transistor 173 from Vb=0 V to Vb=−18 V. The threshold voltage of the drive transistor 173 is therefore set to be higher than the voltage which is held by the capacitor 174 in the case where the signal voltage corresponding to the maximum gradation level is written in the luminescent element 370.

Next, at time t31, the scan pulse SCAN (k) transits from high level to low level, which switches the scan transistor 171 on. This allows conduction between the data line 166 and the first electrode of the capacitor 174, with the result that the data line voltage DATA (j) is provided to the first electrode of the capacitor 174. At the same time, the reset transistor 172 turns on. This allows conduction between the second electrode of the capacitor 174 and the bias line 165 for the luminescent pixels 370 in the "k−1"-th row. The bias line 165 for the luminescent pixels 370 in the (k−1)-th row is supplied with the back gate pulse BG (k−1). At time t31, the voltage of the back gate pulse BG (k−1) is −18 V, and the second electrode of the capacitor 174 therefore has a voltage of −18 V.

Subsequently, at time t32, the back gate pulse BG (k−1) transits from low level to high level, which changes the voltage of the bias line 165 for the luminescent pixels 370 in the (k−1)-th row from −18 V to 0 V. Accordingly, the voltage at the second electrode of the capacitor 174 also changes from −18 V to 0 V.

Consequently, as in the case of the first embodiment, even when the signal voltage corresponding to the maximum gradation level is written, the drain current Id remains no more than the allowable current because of the Vgs-Id characteristics of Vbs=−18 V shown in FIG. 11, so that a voltage drop in the bias line can be sufficiently prevented during the writing period. This allows the capacitor 174 to hold a voltage which corresponds to the signal voltage, without influence of a voltage drop in the first power line 161.

Next, at time t33, the scan pulse SCAN (k) transits from low level to high level, which switches the scan transistor 171 and the reset transistor 172 off. Consequently, the capacitor 174 holds the voltage applied immediately before the time t33. This means that the capacitor 174 holds the voltage which corresponds to the signal voltage, without influence of a voltage drop in the first power line 161.

In other words, the voltage held by the capacitor 174 is determined according to the voltage which is provided to the first electrode of the capacitor 174 and the voltage which is provided to the second electrode of the capacitor 174 when the scan pulse SCAN (k) transits from low level to high level. Thus, in the organic EL display device 300 according to the present embodiment, it is required that, at time t33 when the scan pulse (k) transits from low level to high level, the bias line 165 for the luminescent pixels 370 in the (k−1)-th row have a voltage of 0 V owing to the back gate pulse BG(k−1) at high level.

Next, at time t34, the back gate pulse BG (k) transits from low level to high level, with the result that the back gate voltage of the drive transistor 173 increases from Vb=−18 V to Vb=0 V. The threshold voltage of the drive transistor 173 therefore becomes lower, so that the drain current Id corresponding to the voltage held by the capacitor 174, which voltage corresponds to the signal voltage, is provided to the luminescent element 175 which thereby starts to produce luminescence.

After this, in the period from time t34 to t35, the back gate pulse BG(k) stays at high level, which allows the luminescent element 175 to keep producing luminescence.

Next, at time t35, as in the case of time t31, the back gate pulse BG (k) transits from high level to low level, which decreases the back gate voltage of the drive transistor 173 from Vb=0 V to Vb=−18 V. The threshold voltage of the drive transistor 173 is therefore set to be higher than the voltage which is held by the capacitor 174 in the case where the signal voltage corresponding to the maximum gradation level is written in the luminescent element 370.

The above-described period from time t30 to time t35 corresponds to one frame period of the organic EL display device 300, and the same operations as those from time t30 to time t35 are repeated after time t35.

As above, in the organic EL display device 300 according to the present embodiment, the reset transistor 172 of the luminescent pixel 370 in the "k"-th row is connected to, instead of the reference power line 163, the bias power line 165 for the luminescent pixels 370 in the "k−1"-th row, as compared to the organic EL display device 100 according to the first embodiment. That is, the reference power line 163 for the luminescent pixels 370 in the "k"-th row and the bias line 165 for the luminescent pixels 370 in the "k−1"-th row are the same line.

This allows the organic EL display device 300 to further reduce the number of wiring channels and thereby greatly reduce the size of the circuitry design as compared to the organic EL display device 100.

Furthermore, in the organic EL display device 300, as in the case of the organic EL display device 100 according to the first embodiment, when the scan pulse SCAN (k) which is provided to the scan line 164 for the luminescent pixels 370 in the "k"-th row transits from low level to high level (at time t33), the back gate pulse BG (k−1) which is provided to the bias line 165 for the luminescent pixels 370 in the "k−1"-th row transits to high level so that 0 V is set at the second electrode of the capacitor 174. In other words, the drive transistor 173 in the luminescent pixel 370 in the "k−1"-th row is supplied with a predetermined reference voltage through the bias line 165 for the "k−1"-th row so that the drive transistor 173 is placed in a conducting state, and at the same time, the second electrode of the capacitor 174 in the luminescent pixel 370 in the "k"-th row is supplied with a predetermined reference voltage Vref through the bias line 165 for the "k−1"-th row.

At time t33, the luminescent pixel 370 in the "k−1"-th row is producing luminescence while the luminescent pixel 370 in the "k"-th row is producing no luminescence. Thus, even when the reset transistor 172 in the luminescent pixel 370 in the "k"-th row is connected to, instead of the reference power line 163 shown in FIGS. 1 and 2, the bias line 165 for the luminescent pixel 370 in the "k−1"-th row, there are no operational problems. More specifically, the drive transistor 173 of the luminescent pixel 370 in the "k"-th row is supplied with the predetermined bias voltage through the bias line 165 and thereby placed in a non-conducting state when the luminescent pixel 370 in the "k−1"-th row produces luminescence, with the result that no operational problems occur even when the predetermined reference voltage Vref is set for the second electrode of the capacitor 174 of the luminescent pixel 370 in the "k"-th row through the bias line 165 for the luminescent pixel 370 in the "k−1"-th row in the period for which the luminescent pixel 370 in the "k−1"-th row produces luminescence.

Furthermore, in the organic EL display device 300, the drive transistor 173 in the luminescent pixel 370 in the "k−1"-th row is supplied with the predetermined bias voltage through the bias line 165 for the luminescent pixel 370 in the "k−1"-th row and thereby placed in a non-conducting state, and at the same time, the reset transistor 172 in the luminescent pixel 370 in the "k"-th row is placed in a non-conducting state so that the second electrode of the capacitor 174 in the luminescent pixel 370 in the "k"-th row is not supplied with the predetermined bias voltage through the bias line 165 for the luminescent pixel 370 in the "k−1"-th row.

At this time, the luminescent pixel 370 in the "k−1"-th row is producing no luminescence while the luminescent pixel 370 in the "k"-th row is producing luminescence. Thus, even when the reset transistor 172 in the luminescent pixel 370 in the "k"-th row is connected to, instead of the reference power line 163 shown in FIGS. 1 and 2, the bias line 165 for the luminescent pixel 370 in the "k−1"-th row, there are no operational problems. More specifically, when the reset transistor 172 of the luminescent pixel 370 in the "k"-th row is placed in a non-conducting state so that the second electrode of the capacitor 174 in the luminescent pixel 370 in the "k"-th row is not supplied with the predetermined bias voltage of VGL=−18 V through the bias line 165 in the "k−1"-th row, then the predetermined reference voltage set at the second electrode of the capacitor 174 in the "k"-th row will not fluctuate. There is thus no influence on the production of luminescence in the luminescent pixel 370 in the "k−1"-th row.

Variation of Second Embodiment

The organic EL display device according to the variation of the second embodiment is almost the same as the organic EL display device 300 according to the second embodiment except that the timing of the transition of the back gate pulses BG (0) to BG (n) from low level to high level is different.

Figure 14:
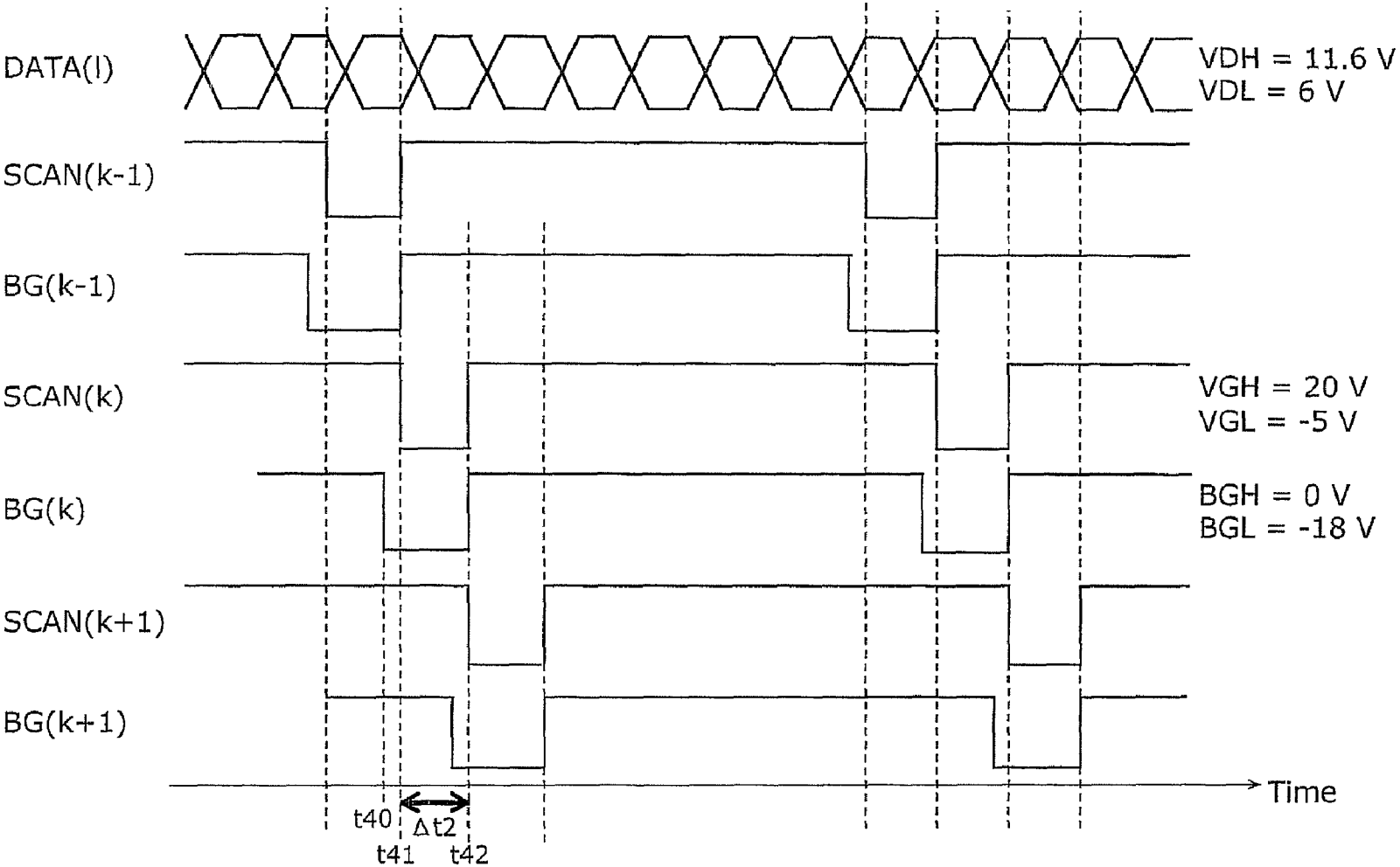
FIG. 14 is a timing chart showing operations of an organic EL display device according to a variation of the second embodiment.

FIG. 14 is a timing chart showing operations of the organic EL display device according to the variation of the present variation.

As shown in FIG. 14, the operations of the organic EL display device according to the present variation are different from the operations of the organic EL display device 300 according to the second embodiment shown in FIG. 13 in points in time at which the back gate pulses BG (0) to BG (k) transit from low level to high level. The following specifically describes the present variation, especially differences thereof from the operations of the organic EL display device 300 according to the second embodiment shown in FIG. 13.

At time t40, which corresponds to time t30 in FIG. 13, the back gate pulse BG (k) transits from high level to low level.

Next, at time t41, the scan pulse SCAN (k) transits from high level to low level, which switches the scan transistor 171 on. At this time t41, as compared to time t31 in FIG. 13, the back gate pulse BG (k−1) which is provided to the bias line 165 for the luminescent pixel 370 in the (k−1)-th row further transits from low level to high level.

Next, at time t42, the scan pulse SCAN (k) transits from low level to high level, and at the same time, the back gate pulse BG (k) also transits from low level to high level.

With the operation timing of the organic EL display device 300 according to the second embodiment shown in FIG. 13, even when the scan pulse SCAN (k) becomes low level at time t31, which starts writing of a signal voltage, the back gate pulse BG (k−1), which is provided to the bias line 165 for the luminescent pixel 370 in the "k−1"-th row that is connected via the reset transistor 172, is at low level. Subsequently, at time t32, the back gate pulse BG (k−1) transits from low level to high level, which causes the second electrode of the capacitor 174 of the luminescent element 370 in the "k"-th row to be supplied with a predetermined reference voltage that is 0 V. In other words, from time t31 to time t32, the voltage corresponding to the signal voltage cannot be written in the capacitor 174.

That is, in the organic EL display device 300 according to the second embodiment, the time Δt1 from time t32 to t33 corresponds to the period for which a signal voltage is actually written.

On the other hand, in the organic EL display device according to the present variation shown in FIG. 14, at the same time when the scan pulse SCAN (k) transits from high level to low level at time t41, the back gate pulse BG (k−1) transits from low level to high level, so that from time t41, the second electrode of the capacitor 174 is supplied with the predetermined reference voltage that is 0 V.

That is, in the organic EL display device according to the present variation, the time Δt2 from time t41 to t42 corresponds to the period for which a signal voltage is actually written.

When it is assumed that the period for which the scan pulse SCAN (k) is at low level is constant, then Δt1<Δt2. This means that the period for which a signal voltage is written in the organic EL display device according to the present variation can be longer than that in the organic EL display device 300 according to the second embodiment.

As above, in the case of the organic EL display device according to the present variation, the timing of the transition of the scan pulse SCAN (k) from high level to low level is the same as the timing of the transition of the back gate pulse BG (k−1) from low level to high level, unlike the organic EL display device 300 according to the second embodiment.

This means that the period for which a signal voltage is actually written in the organic EL display device according to the present variation can be longer than that in the organic EL display device 300 according to the second embodiment.

Third Embodiment

The organic EL display device according to the third embodiment is almost the same as the organic EL display device 100 according to the first embodiment except that the first switching element has one terminal connected to the data line and the other terminal connected to the second electrode of the capacitor and that the second switching element has one terminal connected to the first electrode of the capacitor and the other terminal connected to the third reference power line. The following specifically describes the organic EL display device according to the present embodiment, especially differences thereof from the organic EL display device 100 according to the first embodiment.

Figure 15:
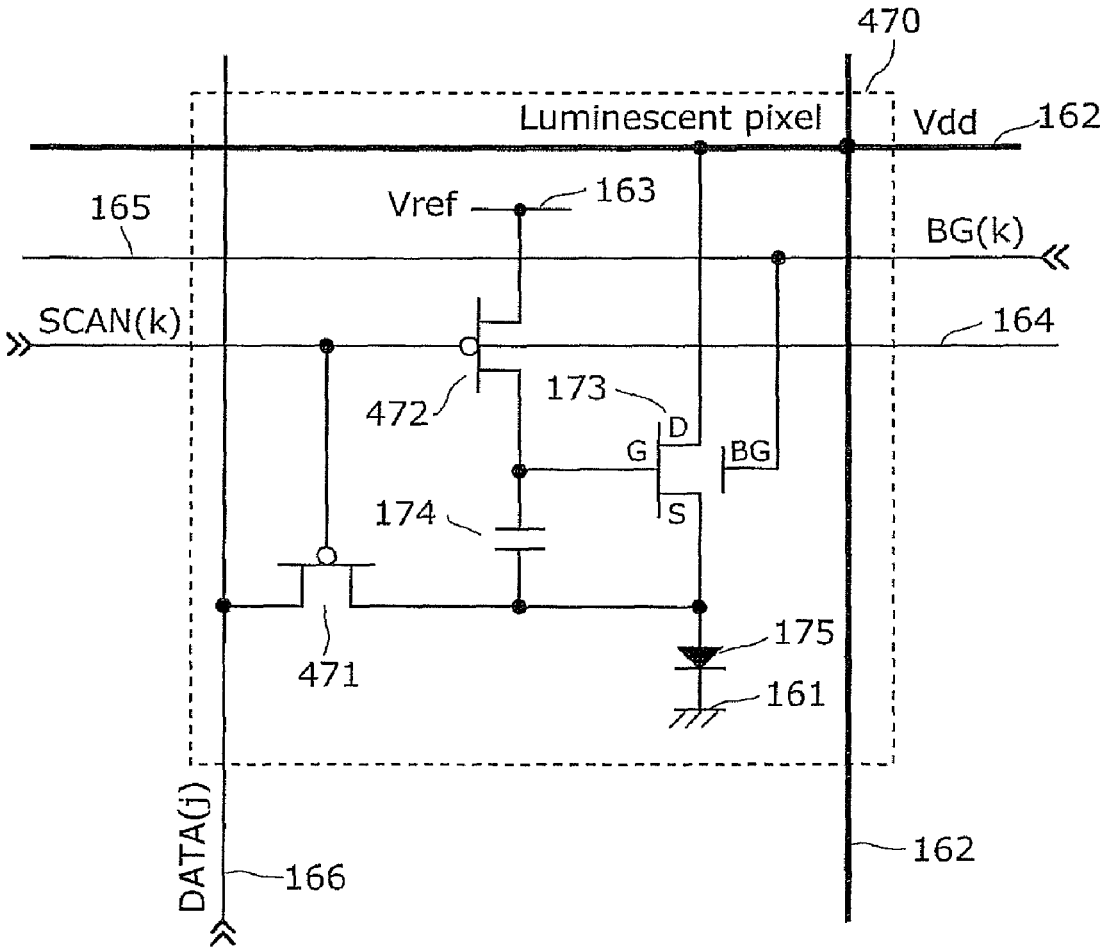
FIG. 15 is a circuit diagram showing a detailed circuitry design of a luminescent pixel included in an organic EL display device according to the third embodiment.

FIG. 15 is a circuit diagram showing a detailed circuitry design of a luminescent pixel included in the organic EL display device according to the present variation.

As compared to the luminescent pixel 170 included in the organic EL display device according to the first embodiment shown in FIG. 2, a luminescent pixel 470 shown in FIG. 15 includes a scan transistor 471 instead of the scan transistor 171, and a reset transistor 472 instead of the reset transistor 172.

The scan transistor 471 is a first switching element in the present embodiment, having one terminal connected to the data line 166 and the other terminal connected to the second electrode of the capacitor 174, and selecting conduction or non-conduction between the data line 166 and the second electrode of the capacitor 174. Specifically, the scan transistor 471 has a gate electrode connected to the scan line 164, one of a source electrode and a drain electrode connected to the data line 166, and the other one of the source electrode and the drain electrode connected to the second electrode of the capacitor 174. That is, the scan transistor 471 is different from the scan transistor 171 shown in FIG. 2 in that the conduction or non-conduction between the data line 166 and the second electrode of the capacitor 174 is selected according to the scan pulse SCAN (k) which is provided from the write drive circuit 110 to the gate electrode through the scan line 164.

The reset transistor 472 is the second switching element in the present embodiment, having one terminal connected to the first electrode of the capacitor 174 and the other terminal connected to the reference power line 163, and selecting conduction or non-conduction between the first electrode of the capacitor 174 and the reference power line 163. Specifically, the reset transistor 472 has a gate electrode connected the write drive circuit 110 via the scan line 164, one of a source electrode and a drain electrode connected to the reference power line 163, and the other one of the source electrode and the drain electrode connected to the first electrode of the capacitor 174. That is, the reset transistor 472 is different from the reset transistor 172 shown in FIG. 2 in that the conduction or non-conduction between the reference power line 163 and the first electrode of the capacitor 174 is selected according to the scan pulse SCAN (k) which is provided from the write drive circuit 110 to the gate electrode through the scan line 164.

Thus, in the luminescent pixel 470 included in the organic EL display device according to the present embodiment, of the first and second electrodes of the capacitor 174, the second electrode connected to the source electrode of the drive transistor 173 is supplied with a signal voltage which is provided through the data line 166 and the scan transistor 471, unlike the luminescent pixel 170 included in the organic EL display device 100 according to the first embodiment. On the other hand, the first electrode connected to the gate electrode of the drive transistor 173 is supplied with the reference voltage Vref which is provided through the reference power line 163 and the reset transistor 472.

The following describes a determination on values of high level voltages and low level voltages of the back gate pulses BG (1) to BG (n) which are provided from the bias voltage control circuit 130 to the luminescent pixel 470 configured as above.

The drive transistor 173 of the luminescent pixel 470 requires (Condition i) and (Condition ii) described in the first embodiment. Furthermore, the drain current corresponding to the maximum gradation level is set at 3 μA, and the allowable current during a writing period is set at 100 pA, as in the case of the first embodiment.

However, in the present embodiment, the signal voltage is written in the second electrode of the capacitor 174, with the result that the absolute values of the data line voltage VDH corresponding to the signal voltage with the maximum gradation level and the data line voltage VDL corresponding to the signal voltage with the minimum gradation level are reversed as compared to the first embodiment. To be specific, VDH=−5.6 V and VDL=0 V. In other words, with VDL=0 V, the data line voltage DATA (j) is 0 V that is the maximum value, and with VDH=−5.6 V, the data line voltage DATA (j) is −5.6 V that is the minimum value.

Figure 16B:
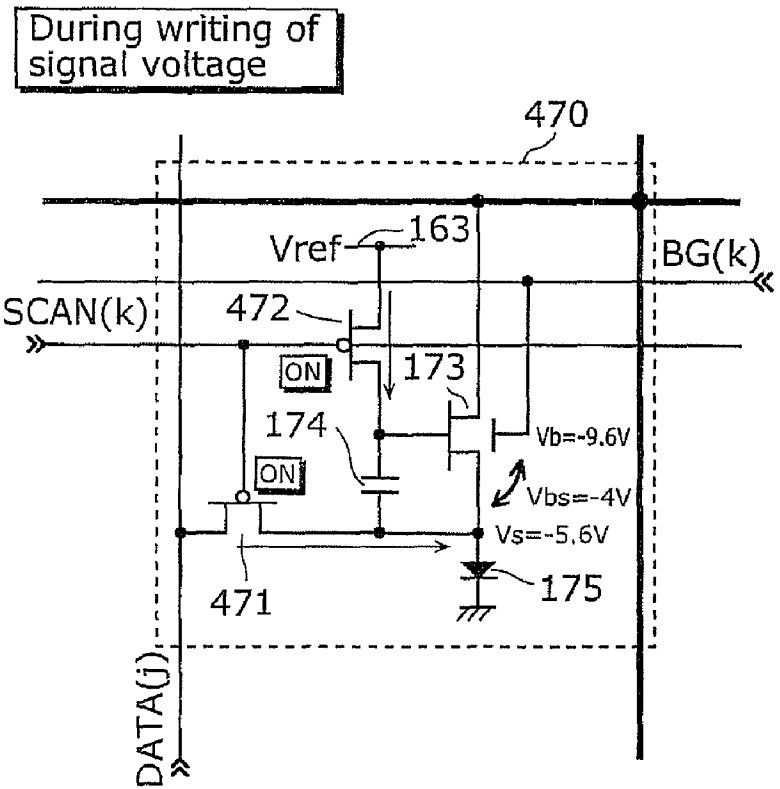
FIG. 16B is a diagram schematically showing a state of a luminescent pixel to which a signal voltage is being written.
Figure 16A:
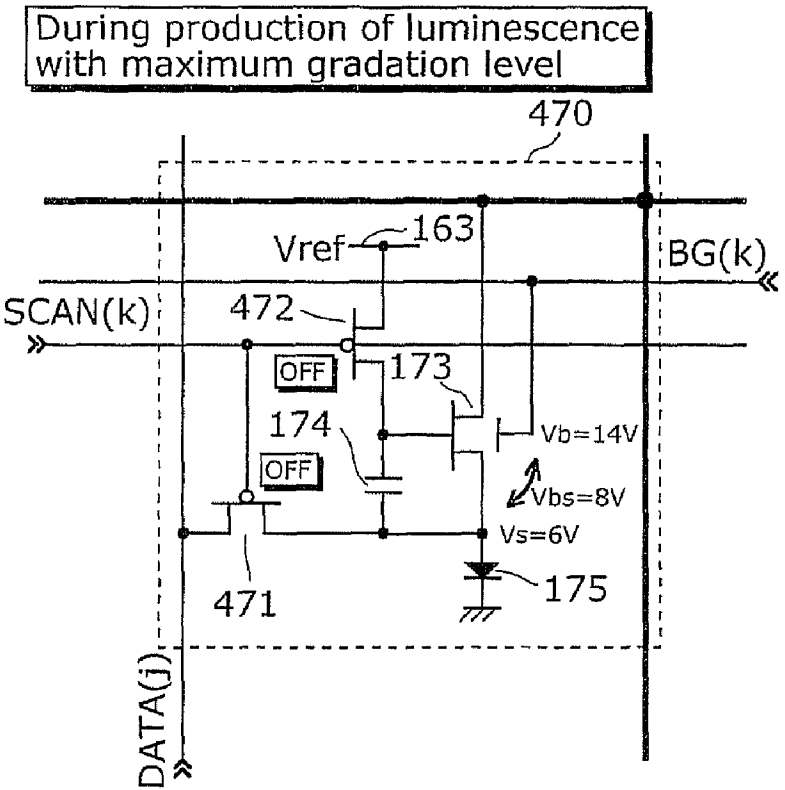
FIG. 16A is a diagram schematically showing a state of a luminescent pixel which is producing luminescence with the maximum gradation level.

FIG. 16A is a diagram schematically showing a state of the luminescent pixel 470 which is producing luminescence with the maximum gradation level. FIG. 16B is a diagram schematically showing a state of the luminescent pixel 470 in which a signal voltage is being written.

When luminescence is produced with the maximum gradation level as shown in FIG. 16A, the source voltage Vs of the drive transistor 173 will be 6 V with the drain current Id=3 μA as above. With the source voltage Vs of 6 V, the back gate voltage Vb for obtaining characteristics corresponding to Vbs=8 V shown in FIG. 3 is determined by Vb=Vs+Vbs, resulting in Vb=14 V. In sum, in the present embodiment, the high level voltage of the back gate pulse BG (1) to the back gate pulse BG (n) is determined as 14 V.

On the other hand, when a signal voltage is being written as shown in FIG. 16B, the reset transistor 472 is conducting so that the gate of the drive transistor 173 is connected to the reference power line 163 via the reset transistor 472. The gate voltage of the drive transistor 173 is the reference voltage Vref, that is, 0 V. The source voltage of the drive transistor 173, which corresponds to the signal voltage with the maximum gradation level, is Vs=−5.6 V. With the source voltage of −5.6 V, the back gate voltage Vb for obtaining characteristics corresponding to Vbs=−4 V shown in FIG. 3 is determined by Vb=Vs+Vbs, resulting in Vb=−9.6 V. In sum, the low level voltage of the back gate pulse BG (1) to back gate pulse BG (n) is determined as −9.6 V.

As above, using the Vgs-Id characteristics for each Vbs shown in FIG. 3, the high level voltage of the back gate pulses BG (1) to BG (n) is determined as 14 V from the back gate-source voltage Vbs at such a level as that (Condition i) the luminescent element 175 is supplied with the drain current of 3 μA corresponding to the maximum gradation level when luminescence is produced with the maximum gradation level. The low level voltage of the back gate pulses BG (1) to BG (n) is determined as −9.6 V from the back gate-source voltage Vbs at such a level that (Condition ii) the luminescent element 175 is supplied with the drain current Id equal to or less than the allowable current when a signal voltage is written. This means that the bias voltage control circuit 130 provides, to the bias lines 165, the back gate pulses BG (1) to BG (n) which have a high level voltage of 14 V, a low level voltage of −9.6 V, and amplitude of 23.6 V. The operations of the organic EL display device according to the present embodiment including the luminescent pixel 470 are the same as the operations of the organic EL display device 100 shown in FIG. 5.

As above, in the organic EL display device according to the present embodiment including the luminescent pixel 470, of the first and second electrodes of the capacitor 174, the second electrode connected to the source electrode of the drive transistor 173 is supplied with a signal voltage which is provided through the data line 166 and the scan transistor 471, unlike the organic EL display device 100 according to the first embodiment. On the other hand, the first electrode connected to the gate electrode of the drive transistor 173 is supplied with the reference voltage Vref which is provided through the reference power line 163 and the reset transistor 472. The predetermined bias voltage that is −9.6 V is applied to the back gate electrode of the drive transistor 173 so that the threshold voltage of the drive transistor 173 is larger than the voltage between the gate electrode and the source electrode, thereby placing the drive transistor 173 in a non-conducting state, and within a period for which the predetermined bias voltage is applied, the scan transistor 471 and the reset transistor 472 are placed in a conducting state so that the reference voltage Vref is set for the first electrode of the capacitor 174 and a signal voltage is provided to the second electrode of the capacitor 174.

This allows the organic EL display device according to the third embodiment to produce the same effects as those produced by the organic EL display device 100 according to the first embodiment.

In the present embodiment, the maximum value of the signal voltage which is provided to the second electrode of the capacitor 174 through the data line 166 is set to be equal to or less than the voltage of the first power line 161. Accordingly, while a signal voltage is provided to the second electrode of the capacitor 174, the voltage at the anode of the luminescent element 175 is equal to or lower than the voltage at the cathode thereof, with the result that no current flows from the reference power line 163 to the luminescent element 175.

As a result, it is possible to prevent a decrease in contrast which is due to unnecessary production of luminescence during the period for which a signal voltage is written. While the signal voltage is −5.6 V or more and 0 V or less and the voltage of the first power line 161 is 0 V in the above description, the signal voltage is not limited to the above example as long as it is equal to or less than the voltage of the first power line 161.

Variation of Third Embodiment

A luminescent element included in an organic EL display device according to the present variation is almost the same as the luminescent pixel 470 included in the organic EL display device according to the third embodiment except that one of the source and the drain of the reset transistor 472 is connected to, instead of the reference power line 163, the bias line 165 for luminescent pixels 570 arranged in a previous row. That is, the organic EL display device according to the present variation is a combination of the organic EL display device 300 according to the second embodiment and the organic EL display device according to the third embodiment.

Figure 17:
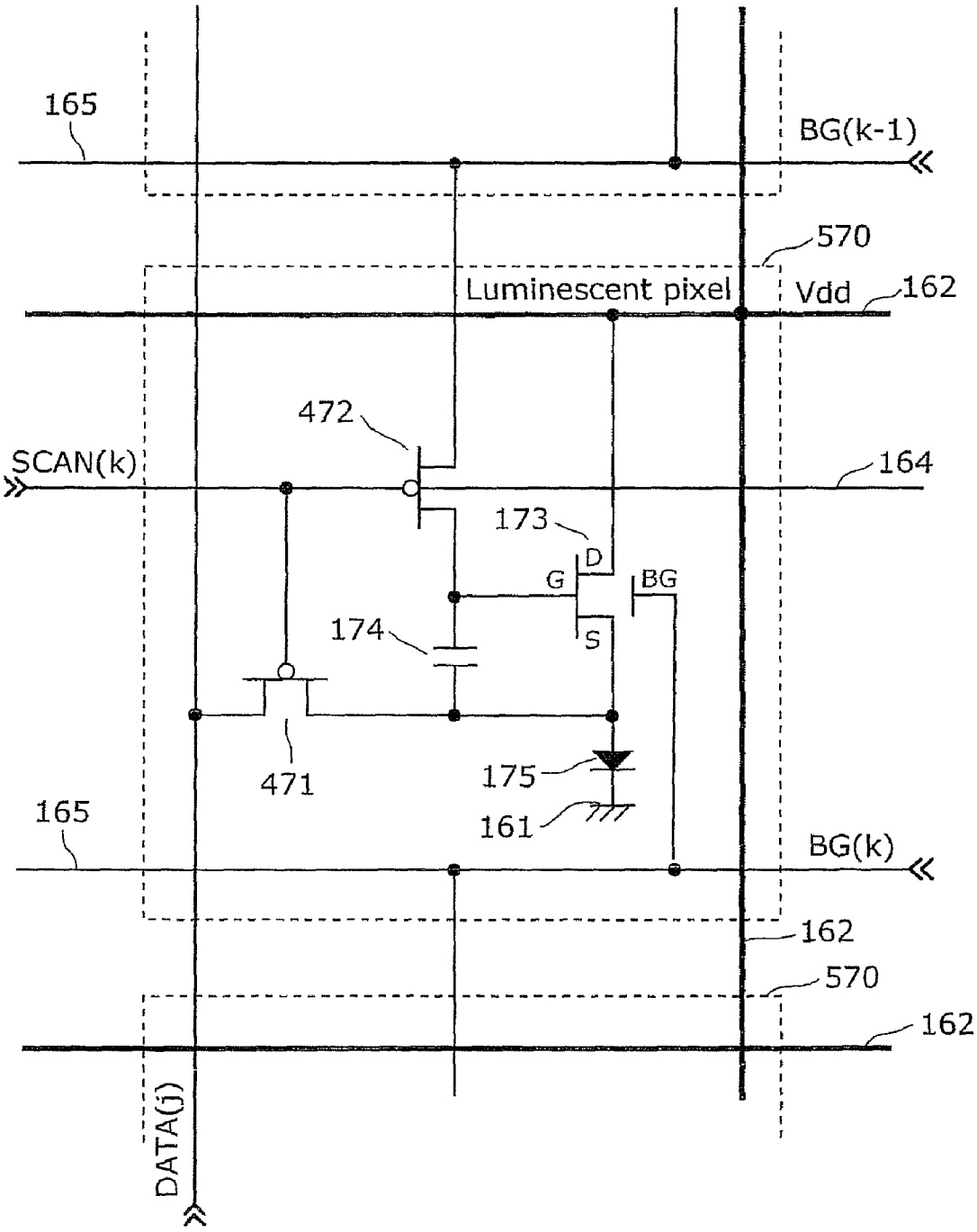
FIG. 17 is a circuit diagram showing a detailed circuitry design of a luminescent pixel included in an organic EL display device according to a variation of the third embodiment.

FIG. 17 is a circuit diagram showing a detailed circuitry design of the luminescent pixel 570 included in the organic EL display device according to the present variation.

As shown in FIG. 17, the reset transistor 472 included in the luminescent pixel 570 is connected to the bias line 165 for the luminescent pixels 570 arranged in a previous row, as in the case of the reset transistor 172 shown in FIG. 10.

The following describes a determination on values of high level voltages and low level voltages of the back gate pulses BG (0) to BG (n) which are provided from the bias voltage control circuit 130 to the luminescent pixel 570 configured as above.

The drive transistor 173 of the luminescent pixel 570 requires (Condition i) and (Condition ii) described in the first embodiment. Furthermore, the drain current corresponding to the maximum gradation level is set at 3 μA, and the allowable current during a writing period is set at 100 pA, as in the case of the first embodiment.

The data line voltage VDH corresponding to the signal voltage with the maximum gradation level and the data line voltage VDL corresponding to the signal voltage with the minimum gradation level have values which are the same in digits as those in the second embodiment but with negative signs. To be specific, VDH=−11.6 V and VDL=−6V.

Figure 18B:
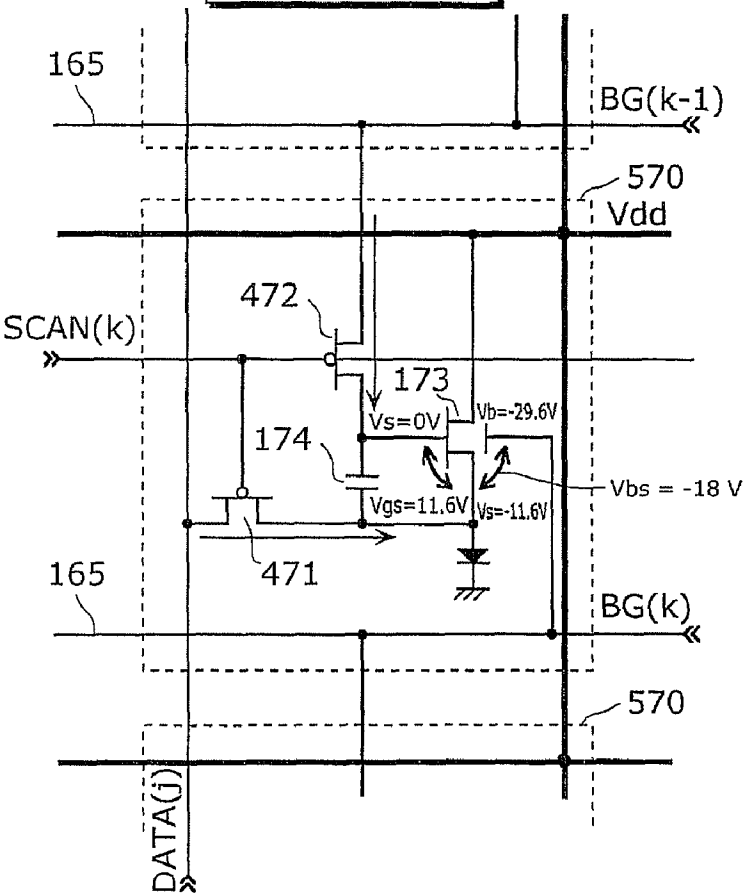
FIG. 18B is a diagram schematically showing a state of a luminescent pixel to which a signal voltage is being written.
Figure 18A:
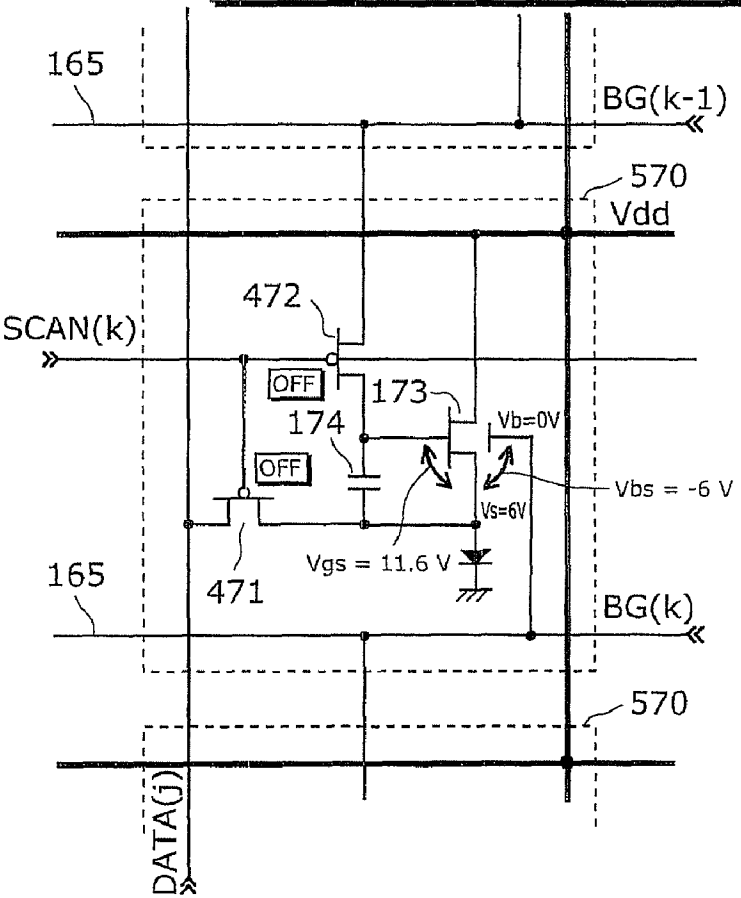
FIG. 18A is a diagram schematically showing a state of a luminescent pixel which is producing luminescence with the maximum gradation level.

FIG. 18A is a diagram schematically showing a state of the luminescent pixel 570 which is producing luminescence with the maximum gradation level. FIG. 18B is a diagram schematically showing a state of the luminescent pixel 570 in which a signal voltage is being written.

When luminescence is produced with the maximum gradation level as shown in FIG. 18A, the source voltage Vs of the drive transistor 173 will be 6 V with the drain current Id=3 μA as above. With the source voltage Vs of 6 V, the back gate voltage Vb for obtaining characteristics corresponding to Vbs=−6 V shown in FIG. 11 is determined by Vb=Vs+Vbs, resulting in Vb=0 V. In sum, in the present embodiment, the high level voltage of the back gate pulse BG (0) to the back gate pulse BG (n) is determined as 0 V.

On the other hand, when a signal voltage is written as shown in FIG. 18B, the reset transistor 472 is conducting so that the gate of the drive transistor 173 is connected to the bias line 165 for a previous row via the reset transistor 472. The gate voltage of the drive transistor 173 is therefore the voltage of the bias line 165 for the luminescent pixels 570 in "k−1"-th row during the period for which a signal voltage is written in the luminescent pixels 570 in the "k"-th row.

In the period for which a signal voltage is written in the luminescent pixels 570 in the "k"-th row, the back gate pulse BG (k−1) is at high level because the writing of a signal voltage in the luminescent pixels 570 in the "k−1"-th row has been completed. This means that the voltage of the bias line 165 for the luminescent pixels 570 in the "k−1"-th row is 0 V.

Accordingly, the gate voltage of the drive transistor 173 of the luminescent pixel 570 in the "k"-th row is 0 V. With the source voltage of −11.6 V, the back gate voltage Vb for obtaining characteristics corresponding to Vbs=−18 V shown in FIG. 11 is determined by Vb=Vs+Vbs, resulting in Vb=−29.6 V. In sum, the low level voltage of the back gate pulse BG (0) to back gate pulse BG (n) is determined as −29.6 V. This means that, in the present variation, the bias voltage control circuit 130 provides, to the bias lines 165 and the dummy bias line 365, the back gate pulses BG (0) to BG (n) which have a high level voltage of 0 V, a low level voltage of −29.6 V, and amplitude of 29.6 V.

The operations of the organic EL display device according to the present variation including the luminescent pixel 570 are the same as the operations of the organic EL display device according to the second embodiment shown in FIG. 13 or the operations of the organic EL display device according to the variation of the second embodiment shown in FIG. 14.

As above, in the organic EL display device including the luminescent pixel 570 according to the variation of the third embodiment, the reset transistor 472 of the luminescent pixel 570 in the "k"-th row is connected to, instead of the reference power line 163, the bias power line 165 for the luminescent pixels 570 in the "k−1"-th row, as compared to the organic EL display device according to the third embodiment. That is, the reference power line 163 for the luminescent pixels 570 in the "k"-th row and the bias line 165 for the luminescent pixels 570 in the "k−1"-th row are the same line.

This allows the organic EL display device according to the present variation to further reduce the number of wiring channels and thereby greatly reduce the size of the circuitry design as compared to the organic EL display device according to the third embodiment.

While the embodiments and variations of the present invention have been described above, the present invention is not limited to these embodiments and variations. The scope of the present invention includes other embodiments that are obtained by making various modification that those skilled in the art could think of, to the present embodiments and variations, or by combining constituents in different embodiments and variations.

Figure 19B:
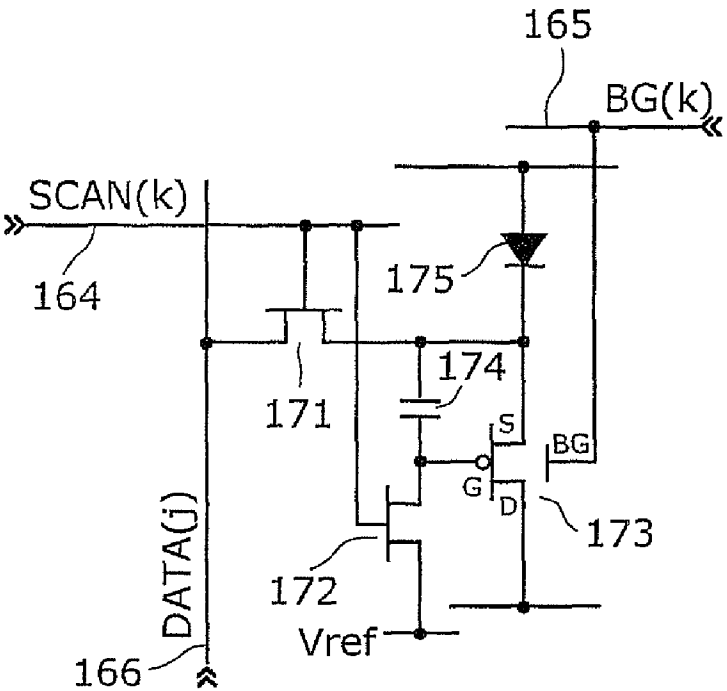
FIG. 19B schematically shows another example of a circuitry design of a luminescent pixel when the drive transistor is a P-type transistor.
Figure 19A:
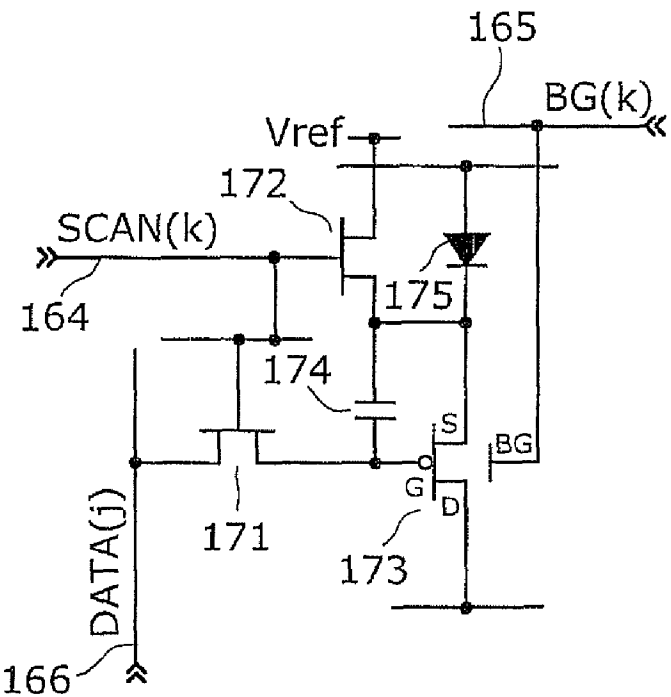
FIG. 19A schematically shows one example of a circuitry design of a luminescent pixel when a drive transistor is a P-type transistor.

For example, in the above description, the scan transistor and the reset transistors are each a P-type transistor which is conducting when the pulse that is applied to the gate electrode is at low level, and the drive transistor is an N-type transistor which turns on when the pulse that is applied to the gate electrode is at high level, but these transistors may each have an opposite polarity with the scan line 164 and the bias line 165 each having an opposite polarity, in a circuitry design shown in FIGS. 19A and 19B, for example.

In the case where such a circuitry design as shown in FIG. 19A is provided with the drive transistor 173 that is a P-type transistor, the predetermined reference voltage Vref which is provided from the third power line is preferably equal to or more than the voltage of the first power line. Accordingly, even when the drive transistor 173 is a P-type transistor, the voltage at the anode of the luminescent element 175 is equal to or lower than the voltage at the cathode thereof with the reference voltage Vref set at the second electrode of the capacitor 174, so that no current flows from the reference power line 163 to the luminescent element 175.

In the case where such a circuitry design as shown in FIG. 19B is provided with the drive transistor 173 that is a P-type transistor, the minimum value of the signal voltage which is provided from the data line 166 is preferably equal to or more than the voltage of the first power line. This makes it possible to prevent a current flow from the luminescent element 175 to the data line 166 during writing of the signal voltage. Consequently, the extinction of the luminescent pixel 175 can be secured during writing of the signal voltage.

The polarity of the drive transistor 173 may be the same as that of the scan transistor 171 and the reset transistor 172.

Furthermore, while the scan transistor and the reset transistor are TFTs in the above description, they may be junction field effect transistors, for example. Alternatively, these transistors may each be a bipolar transistor having a base, a collector, and an emitter.

While the reference power supply 140 and the DC power supply 150 are provided separately in the above embodiments, they may be replaced by one power supply which outputs multiple voltages.

While the first power line 161 is a ground line in the above embodiments, the first power line 161 may be connected to the DC power supply 150 and supplied with a voltage (e.g., 1 V) other than 0 V. Furthermore, this first power line 161 may form a grid pattern or a solid film.

The second power line 162 may form a grid pattern (which is two-dimensional wiring), or may extend in parallel with either the scan line or the data line (which is one-dimensional wiring), or may form a solid film.

While the scan transistor and the reset transistor each undergo the transition between the conducting state and the non-conducting state with the scan pulses SCAN (1) to SCAN (n) which are provided through the common scan line in the above embodiments, it may also be possible to provide the first scan line which supplies a signal for controlling the scan transistor between the conducting state and the non-conducting state and the second scan line which supplies a signal for controlling the reset transistor between the conducting state and the non-conducting state.

Figure 20:
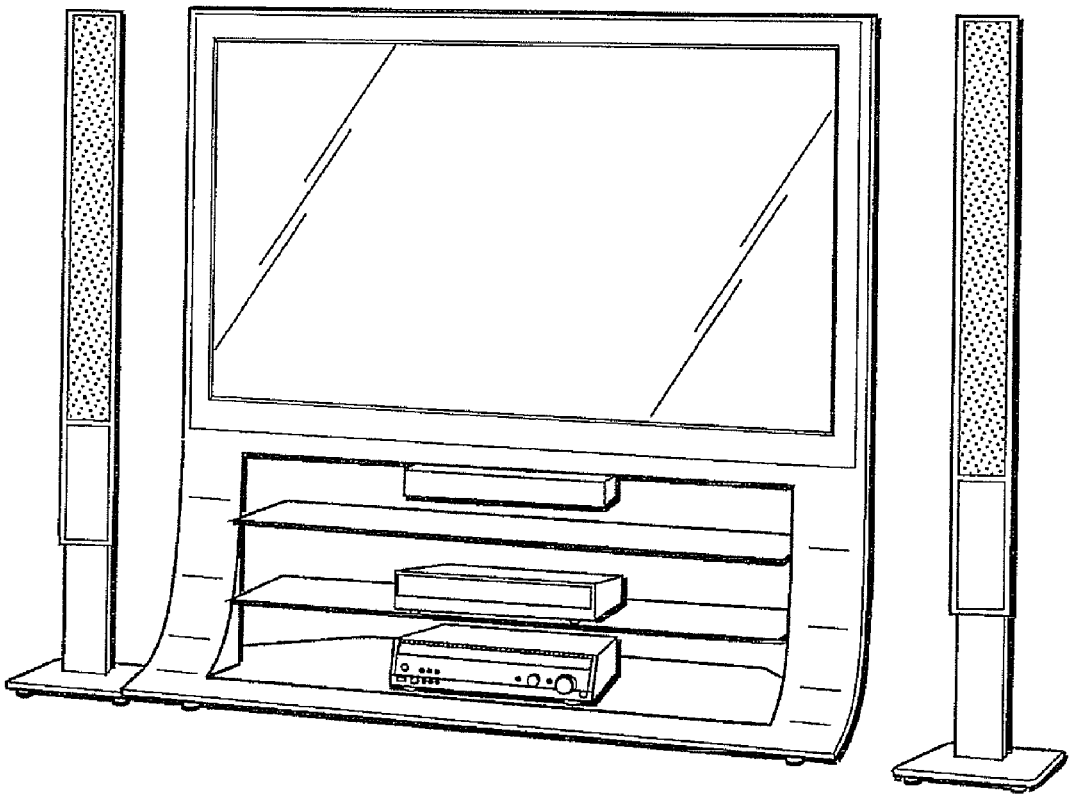
FIG. 20 shows appearance of a thin flat-screen television including the organic EL display device according to an implementation of the present invention.

The organic EL display device according to an implementation of the present invention is, for example, incorporated into such a thin flat-screen television as shown in FIG. 20. A thin flat-screen television including the organic EL display device according to an implementation of the present invention is capable of displaying highly precise images which reflect video signals.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The present invention is useful especially for an active organic EL flat-panel display.

What is claimed is:

1. An organic electroluminescent display device, comprising:

a plurality of pixels arranged in a matrix, each of the plurality of pixels including:

a luminescent element;

a capacitor including a first electrode and a second electrode for holding a voltage;

a driver including a gate electrode connected to the first electrode of the capacitor, a source electrode connected to the second electrode of the capacitor, a drain electrode, and a back gate electrode, the driver allowing a drive current corresponding to the voltage held by the capacitor to flow to the luminescent element to cause the luminescent element to produce a luminescence, the driver being in a non-conducting state when a predetermined bias voltage is provided to the back gate electrode;

a first power line electrically connected to the source electrode of the driver via the luminescent element;

a second power line electrically connected to the drain electrode of the driver;

a third power line being different than the first power line for setting a predetermined reference voltage to the second electrode of the capacitor;

a data line for providing a signal voltage;

a first switch including a first terminal connected to the data line and a second terminal connected to the first electrode of the capacitor, the first switch switching between a first conduction state and a first non-conduction state between the data line and the first electrode of the capacitor;

a second switch including a third terminal connected to the second electrode of the capacitor and a fourth terminal connected to the third power line, the second switch switching between a second conduction state and a second non-conduction state between the second electrode of the capacitor and the third power line; and a bias line for providing the predetermined bias voltage to the back gate electrode;

the organic electroluminescent display device further comprising:

a drive circuit that controls the first switch, the second switch, and the predetermined bias voltage that is provided to the back gate electrode, wherein the predetermined bias voltage is provided to the back gate electrode so that an absolute value of a threshold voltage of the driver is greater than a gate-source voltage between the gate electrode and the source electrode of the driver, the drive circuit:

provides the predetermined bias voltage to the back gate electrode so that the absolute value of the threshold voltage of the driver is greater than the gate-source voltage between the gate electrode and the source electrode to place the driver in the non-conducting state; and sets the predetermined reference voltage to the second electrode of the capacitor and provides the signal voltage to the first electrode of the capacitor when the driver is in the non-conducting state by placing the first switch in the first conduction state and the second switch in the second conduction state during a period in which the predetermined bias voltage is provided to the back gate electrode, and the predetermined bias voltage is set so that the absolute value of the threshold voltage of the driver is greater than the gate-source voltage between the gate electrode and the source electrode when the gate electrode of the driver is provided with a predetermined signal voltage required to cause the luminescent element included in each of the plurality of pixels to produce the luminescence with a maximum gradation level.

2. The organic electroluminescent display device according to claim 1, further comprising:

a trunk power line disposed about a periphery of a display that includes the plurality of pixels arranged in the matrix for providing a predetermined fixed voltage to the display, wherein the second power line of each of the plurality of pixels branches from the trunk power line and corresponds to one of a row and a column of the plurality of pixels arranged in the matrix and forms a grid pattern.

3. The organic electroluminescent display device according to claim 1, further comprising:

a first scan line for providing a first signal for switching the first switch between the first conduction state and the first non-conduction state; and a second scan line for providing a second signal for switching the second switch between the second conduction state and the second non-conduction state.

4. The organic electroluminescent display device according to claim 3, wherein the first scan line and the second scan line comprise a common control line.

5. The organic electroluminescent display device according to claim 3, wherein the first switch and the driver comprise transistors of opposite polarities, the signal voltage is provided to the first electrode of the capacitor during the period in which the predetermined bias voltage is provided to the back gate electrode, and the first scan line and the bias line comprise a common control line.

6. The organic electroluminescent display device according to claim 1, wherein the third power line and the bias line each correspond to a row of the plurality of pixels arranged in the matrix, and the third power line that corresponds to the row of the plurality of pixels comprises an adjacent bias line that corresponds to an adjacent row of the plurality of pixels arranged in the matrix.

7. The organic electroluminescent display device according to claim 6, wherein the drive circuit provides, via the adjacent bias line that corresponds to the adjacent row, the predetermined reference voltage to the driver included in each of the plurality of pixels arranged in the adjacent row to place the driver in a conducting state, and sets, via the third power line that corresponds to the row, the predetermined reference voltage to the second electrode of the capacitor included in each of the plurality of pixels arranged in the row.

8. The organic electroluminescent display device according to claim 7, wherein the drive circuit provides, via the adjacent bias line that corresponds to the adjacent row, the predetermined reference voltage to the driver included in each of the plurality of pixels arranged in the adjacent row to place the driver in the non-conducting state, and switches the second switch to the second non-conduction state so that the predetermined bias voltage is not set to the second electrode of the capacitor included in each of the plurality of pixels arranged in the row through the third power line that corresponds to the row.

9. The organic electroluminescent display device according to claim 1, wherein the driver comprises an N-type transistor.

10. The organic electroluminescent display device according to claim 9, wherein the predetermined reference voltage that is set by the third power line is at most equal to a voltage of the first power line.

11. The organic electroluminescent display device according to claim 9, wherein the drive circuit:

provides the signal voltage to the first electrode of the capacitor and then places the first switch in the first non-conduction state, provides, to the back gate electrode, a voltage greater than the predetermined bias voltage so that the absolute value of the threshold voltage of the driver is less than the gate-source voltage between the gate electrode and the source electrode to place the driver in a conducting state, and provides, to the luminescent element, a drive current corresponding to the voltage held by the capacitor to cause the luminescent element to produce the luminescence.

12. The organic electroluminescent display device according to claim 1, wherein the driver comprises a P-type transistor.

13. The organic electroluminescent display device according to claim 12, wherein the predetermined reference voltage that is set by the third power line is at least equal to a voltage of the first power line.

14. The organic electroluminescent display device according to claim 12, wherein the drive circuit:

provides the signal voltage to the first electrode of the capacitor and then places the first switch in the first non-conduction state, provides, to the back gate electrode, a voltage less than the predetermined bias voltage so that the absolute value of the threshold voltage of the driver is less than the gate-source voltage between the gate electrode and the source electrode to place the driver in a conducting state, and provides, to the luminescent element, a drive current corresponding to the voltage held by the capacitor to cause the luminescent element to produce the luminescence.

15. A method of controlling an organic electroluminescent display device that includes:

a luminescent element;

a capacitor including a first electrode and a second electrode for holding a voltage;

a driver including a gate electrode connected to the first electrode of the capacitor, a source electrode connected to the second electrode of the capacitor, a drain electrode, and a back gate electrode, the driver allowing a drive current corresponding to the voltage held by the capacitor to flow to the luminescent element to cause the luminescent element to produce a luminescence, the driver being in a non-conducting state when a predetermined bias voltage is provided to the back gate electrode;

a first power line electrically connected to the source electrode of the driver via the luminescent element;

a second power line electrically connected to the drain electrode of the driver;

a third power line being different than the first power line for setting a predetermined reference voltage to the second electrode of the capacitor;

a data line for providing a signal voltage;

a first switch including a first terminal connected to the data line and a second terminal connected to the first electrode of the capacitor, the first switch switching between a first conduction state and a first non-conduction state between the data line and the first electrode of the capacitor;

a second switch including a third terminal connected to the second electrode of the capacitor and a fourth terminal connected to the third power line, the second switch switching between a second conduction state and a second non-conduction state between the second electrode of the capacitor and the third power line; and a bias line for providing the predetermined bias voltage to the back gate electrode, wherein the predetermined bias voltage is provided to the back gate electrode so that an absolute value of a threshold voltage of the driver is greater than a gate-source voltage between the gate electrode and the source electrode of the driver, the method comprising:

providing the predetermined bias voltage to the back gate electrode so that the absolute value of the threshold voltage of the driver is greater than the gate-source voltage between the gate electrode and the source electrode to place the driver in the non-conducting state; and setting the predetermined reference voltage to the second electrode of the capacitor and providing the signal voltage to the first electrode of the capacitor when the driver is in the non-conducting state by placing the first switch in the first conduction state and the second switch in the second conduction state during a period in which the predetermined bias voltage is provided to the back gate electrode, wherein the predetermined bias voltage is set so that the absolute value of the threshold voltage of the driver is greater than the gate-source voltage between the gate electrode and the source electrode when the gate electrode of the driver is provided with a predetermined signal voltage required to cause the luminescent element included in each of the plurality of pixels to produce the luminescence with a maximum gradation level.

16. An organic electroluminescent display device, comprising:

a plurality of pixels arranged in a matrix, each of the plurality of pixels including:

a luminescent element;

a capacitor including a first electrode and a second electrode for holding a voltage;

a driver including a gate electrode connected to the first electrode of the capacitor, a source electrode connected to the second electrode of the capacitor, a drain electrode, and a back gate electrode, the driver allowing a drive current corresponding to the voltage held by the capacitor to flow to the luminescent element to cause the luminescent element to produce a luminescence, the driver being in a non-conducting state when a predetermined bias voltage is provided to the back gate electrode;

a first power line electrically connected to the source electrode of the driver via the luminescent element;

a second power line electrically connected to the drain electrode of the driver;

a third power line being different than the first power line for setting a predetermined reference voltage to the first electrode of the capacitor;

a data line for providing a signal voltage;

a first switch including a first terminal connected to the data line and a second terminal connected to the second electrode of the capacitor, the first switch switching between a first conduction state and a first non-conduction state between the data line and the second electrode of the capacitor;

a second switch including a third terminal connected to the first electrode of the capacitor and a fourth terminal connected to the third power line, the second switch switching between a second conduction state and a second non-conduction state between the first electrode of the capacitor and the third power line; and a bias line for providing the predetermined bias voltage to the back gate electrode;

the organic electroluminescent display device further comprising:

a drive circuit that controls the first switch, the second switch, and the predetermined bias voltage that is provided to the back gate electrode, wherein the predetermined bias voltage is provided to the back gate electrode so that an absolute value of a threshold voltage of the driver is greater than a gate-source voltage between the gate electrode and the source electrode of the driver, and set so that the absolute value of the threshold voltage of the driver is greater than the gate-source voltage between the gate electrode and the source electrode when the gate electrode of the driver is provided with a predetermined signal voltage required to cause the luminescent element included in each of the plurality of pixels to produce the luminescence with a maximum gradation level, and the drive circuit:

provides the predetermined bias voltage to the back gate electrode so that the absolute value of the threshold voltage of the driver is greater than the gate-source voltage between the gate electrode and the source electrode to place the driver in the non-conducting state; and sets the predetermined reference voltage to the first electrode of the capacitor and provides the signal voltage to the second electrode of the capacitor when the driver is in the non-conducting state by placing the first switch in the first conduction state and the second switch in the second conduction state during a period in which the predetermined bias voltage is provided to the back gate electrode.

17. The organic electroluminescent display device according to claim 16, further comprising:

a trunk power line disposed about a periphery of a display that includes the plurality of pixels arranged in the matrix for providing a predetermined fixed voltage to the display, wherein the second power line of each of the plurality of pixels branches from the trunk power line and corresponds to one of a row and a column of the plurality of pixels arranged in the matrix and forms a grid pattern.

18. The organic electroluminescent display device according to claim 16, further comprising:

a first scan line for providing a first signal for switching the first switch between the first conduction state and the first non-conduction state; and a second scan line for providing a second signal for switching the second switch between the second conduction state and the second non-conduction state.

19. The organic electroluminescent display device according to claim 18, wherein the first scan line and the second scan line comprise a common control line.

20. The organic electroluminescent display device according to claim 18, wherein the first switch and the driver comprise transistors of opposite polarities, the signal voltage is provided to the second electrode of the capacitor during the period in which the predetermined bias voltage is provided to the back gate electrode, and the first scan line and the bias line comprise a common control line.

21. The organic electroluminescent display device according to claim 16, wherein the third power line and the bias line each correspond to a row of the plurality of pixels arranged in the matrix, and the third power line that corresponds to the row of the plurality of pixels comprises an adjacent bias line that corresponds to an adjacent row of the plurality of pixels.

22. The organic electroluminescent display device according to claim 21, wherein the drive circuit provides, via the adjacent bias line that corresponds to the adjacent row, the predetermined reference voltage to the driver included in each of the plurality of pixels arranged in the adjacent row to place the driver in a conducting state, and sets, via the third power line that corresponds to the row, the predetermined reference voltage to the first electrode of the capacitor included in each of the plurality of pixels arranged in the row.

23. The organic electroluminescent display device according to claim 22, wherein the drive circuit provides, via the adjacent bias line that corresponds to the adjacent row, the predetermined reference voltage to the driver included in each of the plurality of pixels arranged in the adjacent row to place the driver in the non-conducting state, and switches the second switch to the second non-conduction state so that the predetermined bias voltage is not set to the first electrode of the capacitor included in each of the plurality of pixels arranged in the row through the third power line that corresponds to the row.

24. The organic electroluminescent display device according to claim 16, wherein the driver comprises an N-type transistor.

25. The organic electroluminescent display device according to claim 24, wherein the signal voltage that is provided by the data line is at most equal to a voltage of the first power line.

26. The organic electroluminescent display device according to claim 24, wherein the drive circuit:

provides the signal voltage to the second electrode of the capacitor and then places the first switch in the first non-conduction state, provides, to the back gate electrode, a voltage greater than the predetermined bias voltage so that the absolute value of the threshold voltage of the driver is less than the gate-source voltage between the gate electrode and the source electrode to place the driver in a conducting state, and provides, to the luminescent element, a drive current corresponding to the voltage held by the capacitor to cause the luminescent element to produce the luminescence.

27. The organic electroluminescent display device according to claim 16, wherein the driver comprises a P-type transistor.

28. The organic electroluminescent display device according to claim 27, wherein the signal voltage that is provided by the data line is at least equal to a voltage of the first power line.

29. The organic electroluminescent display device according to claim 27, wherein the drive circuit:

provides the signal voltage to the second electrode of the capacitor and then places the first switch in the first non-conduction state, provides, to the back gate electrode, a voltage less than the predetermined bias voltage so that the absolute value of the threshold voltage of the driver is less than the gate-source voltage between the gate electrode and the source electrode to place the driver in a conducting state, and provides, to the luminescent element, a drive current corresponding to the voltage held by the capacitor to cause the luminescent element to produce the luminescence.

30. A method of controlling an organic electroluminescent display device that includes:

a luminescent element;

a capacitor including a first electrode and a second electrode for holding a voltage;

a driver including a gate electrode connected to the first electrode of the capacitor, a source electrode connected to the second electrode of the capacitor, a drain electrode, and a back gate electrode, the driver allowing a drive current corresponding to the voltage held by the capacitor to flow to the luminescent element to cause the luminescent element to produce a luminescence, the driver being in a non-conducting state when a predetermined bias voltage is provided to the back gate electrode;

a first power line electrically connected to the source electrode of the driver via the luminescent element;

a second power line electrically connected to the drain electrode of the driver;

a third power line being different than the first power line for setting a predetermined reference voltage to the first electrode of the capacitor;

a data line for providing a signal voltage;

a first switch including a first terminal connected to the data line and a second terminal connected to the second electrode of the capacitor, the first switch switching between a first conduction state and a first non-conduction state between the data line and the second electrode of the capacitor;

a second switch including a third terminal connected to the first electrode of the capacitor and a fourth terminal connected to the third power line, the second switch switching between a second conduction state and a second non-conduction state between the first electrode of the capacitor and the third power line; and a bias line for providing the predetermined bias voltage to the back gate electrode, wherein the predetermined bias voltage is provided to the back gate electrode so that an absolute value of a threshold voltage of the driver is greater than a gate-source voltage between the gate electrode and the source electrode of the driver, and set so that the absolute value of the threshold voltage of the driver is greater than the gate-source voltage between the gate electrode and the source electrode when the gate electrode of the driver is provided with a predetermined signal voltage required to cause the luminescent element included in each of the plurality of pixels to produce the luminescence with a maximum gradation level, the method comprising:

providing the predetermined bias voltage to the back gate electrode so that the absolute value of the threshold voltage of the driver is greater than the gate-source voltage between the gate electrode and the source electrode to place the driver in the non-conducting state; and setting the predetermined reference voltage to the first electrode of the capacitor and providing the signal voltage to the second electrode of the capacitor when the driver is in the non-conducting state by placing the first switch in the first conduction state and the second switch in the second conduction state during a period in which the predetermined bias voltage is provided to the back gate electrode.

31. The organic electroluminescent display device according to claim 1, wherein the driver circuit provides the predetermined reference voltage to the second electrode of the capacitor by placing the second switch in the second conduction state while the signal voltage is provided to the first electrode of the capacitor during the period in which the predetermined bias voltage is provided to the back gate electrode.

32. The organic electroluminescent display device according to claim 1, wherein the plurality of pixels arranged in the matrix is sequentially lit on a per-row basis according to the voltage held by the capacitor based on the signal voltage and the predetermined reference voltage.

* * * * *